US005861712A

United States Patent [19]

Beetson et al.

[11] Patent Number: 5,861,712

[45] **Date of Patent: *Jan. 19, 1999**

[54] ELECTRON SOURCE WITH GRID SPACER

[75] Inventors: John Beetson, Skelmorlie; Andrew Knox, Garnock Lodge, both of United Kingdom

[73] Assignee: International Business Machines Corporation, Armonk, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 675,552

[22] Filed: Jul. 3, 1996

[51] Int. Cl.[6] ..... H01J 29/68

[52] U.S. Cl. ..... 313/442; 313/422; 313/497; 315/169.1

[58] Field of Search ..... 313/495, 496, 313/497, 336, 309, 351, 422, 421, 431, 491, 492; 315/169.1, 169.3, 169.4, 3

[56] References Cited

U.S. PATENT DOCUMENTS

| | | | |
|---|---|---|---|
| 3,789,471 | 2/1974 | Spindt et al. | 445/52 |
| 4,498,952 | 2/1985 | Christensen | 313/309 |
| 4,663,559 | 5/1987 | Christensen | 313/336 |
| 4,672,272 | 6/1987 | Littwin | 315/169.1 |
| 4,763,041 | 8/1988 | Segawa | 313/496 |
| 4,955,681 | 9/1990 | Sekihara et al. | 313/495 |
| 5,227,691 | 7/1993 | Murai et al. | 313/497 |
| 5,270,617 | 12/1993 | Nonomura et al. | 315/169.1 |
| 5,473,222 | 12/1995 | Thoeny et al. | 315/169.1 |

OTHER PUBLICATIONS

O. Klemperer et al., *Electron Optics* 3rd Ed. Cambridge University Press pp. 131–133. 1971 (no month).

*Foundation of Electromagnetic Theory,* J. Reitz et al. Addison–Wesley Publishing Co. pp. 201–204. 1979 (no month).

*Primary Examiner*—Sandra O 'Shea
*Assistant Examiner*—Michael Day
*Attorney, Agent, or Firm*—Scully, Scott, Murphy & Presser; Daniel P. Morris

[57] ABSTRACT

An electron source having a cathode and a permanent magnet perforated by a plurality of channels extending between opposite poles thereof. The magnet generates, in each channel, a magnetic field which forms electrons received from the cathode into an electron beam for guidance towards a target. An electrode grid is disposed between the cathode and the magnet for controlling flow of electrons from the cathode into each channel. A magnetic field null region of each magnetic field is positioned at a location remote from the electrode grid. Because the null region is positioned remotely from the grid electrodes, flow of electrons can be improved without increasing electrode drive voltage.

43 Claims, 20 Drawing Sheets

ELECTRON SOURCE WITH GRID SPACER

BACKGROUND OF THE INVENTION

1. Technical Field

The present invention relates to a magnetic matrix electron source and methods of manufacture thereof.

A magnetic matrix electron source of the present invention is particularly although not exclusively useful in display applications, especially flat panel display applications. Such applications include television receivers and visual display units for computers, especially although not exclusively portable computers, personal organizers, communications equipment, and the like. Flat panel display devices based on a magnetic matrix electron source of the present invention will hereinafter by referred to as Magnetic Matrix Displays.

2. Prior Art

Conventional flat panel displays, such as liquid crystal display panels, and field emission displays, are complicated to manufacture because they each involve a relatively high level of semiconductor fabrication, delicate materials, and high tolerances.

SUMMARY OF THE INVENTION

In accordance with the present invention, there is provided an electron source comprising: cathode means; a permanent magnet perforated by a plurality of channels extending between opposite poles of the magnet, the magnet generating, in each channel, a magnetic field which forms electrons received from the cathode means into an electron beam for guidance towards a target; grid electrode means disposed between the cathode means and the magnet for controlling flow of electrons from the cathode means into each channel; and positioning means for positioning a magnetic field null region of each magnetic field at a location remote from the grid electrode means.

Because the null region is positioned remotely from the grid electrodes, flow of electrons into the channels can be improved without increasing electrode drive voltages.

In a preferred embodiment of the present invention, the positioning means comprises spacing means for spacing the grid electrode means from the surface of the magnet. The grid electrode means may be disposed on the surface of the cathode means facing the magnet.

In another embodiment of the present invention, the grid electrode means is disposed on the surface of the magnet facing the cathode means. The positioning means may comprise a tapered entrance to each channel, the end of the taper having the largest surface area facing the cathode means. Alternatively, the positioning means may comprise a non-uniform orientation of magnetic domains within the magnet. In another embodiment of the present invention, the positioning means comprises a high magnetic permeability material. The material may be located in a layer disposed on the surface of the magnet facing the cathode means. Indeed, the material may be located in the grid electrode means. The material layer preferably comprises iron.

The channels are preferably disposed in the magnet in a two dimensional array of rows and columns.

The grid electrode means preferably comprises a plurality of parallel row conductors and a plurality of parallel column conductors arranged orthogonally to the row conductors, each channel being located at a different intersection of a row conductor and a column conductor.

The cathode means may comprise a field emission device. Alternatively, the cathode means may comprise any of a photocathode; a thermionic emitter; a thin film emitter; or a semiconductor emitter.

The magnet preferably comprises ferrite. In preferred embodiments of the present invention, the magnet also comprises a binder. The binder preferably comprises silicon dioxide.

Each channel is preferably circular in cross-section. However, each channel may be quadrilateral in cross-section. In some embodiments of the present invention, each channel may be rectangular in cross-section. In other embodiments of the present invention, each channel may be square in cross-section. Preferably, the corners and edges of each channel are radiussed.

In a preferred embodiment of the present invention, the magnet comprises a stack of perforated laminations, the perforations in each lamination being aligned with the perforations in an adjacent lamination to continue the channel through the stack. Each lamination in the stack is preferably separated from an adjacent lamination by a spacer.

Anode means is preferably disposed on the surface of the magnet remote from the cathode for accelerating electrons through the channels.

In preferred embodiments of the present invention, the anode means comprises a plurality of anodes extending parallel to the columns of channels, the anodes comprising pairs of anodes each corresponding to a different column of channels, each pair comprising first and second anodes respectively extending along opposite sides of the corresponding column of anodes, the first anodes being interconnected and the second anodes being interconnected.

Preferably, the first and second anodes comprise lateral formations surrounding corners of the channels.

In preferred embodiments of the present invention, there is provided means for applying a deflection voltage across the first and second anodes to deflect electron beams emerging from the channels.

The present invention extends to a display device comprising: an electron source as hereinbefore described; a screen for receiving electrons from the electron source, the screen having a phosphor coating facing the side of the magnet remote from the cathode; and means for supplying control signals to the grid electrode means and the anode means to selectively control flow of electrons from the cathode to the phosphor coating via the channels thereby to produce an image on the screen.

The present invention also extends to a display device comprising: an electron source with deflection anodes as hereinbefore described; a screen for receiving electrons form the electron source, the screen having a phosphor coating facing the side of the magnet remote from the cathode, the phosphor coating comprising a plurality of groups of different phosphors, the groups being arranged in a repetitive pattern, each group corresponding to a different channel; means for supplying control signals to the grid electrode means and the anode means to selectively control flow of electrons from the cathode to the phosphor coating via the channels ; and deflection means for supplying deflection signals to the anode means to sequentially address electrons emerging from the channels to different ones of the phosphors for the phosphor coating thereby to produce a color image on the screen. The phosphors preferably comprise Red, Green, and Blue phosphors. The deflection means is preferably arranged to address electrons emerging from the channels to different ones of the phosphors in the repetitive sequence Red, Green, Red, Blue, . . ..

In preferred embodiments of the present invention, there is provided a final anode layer disposed on the phosphor coating.

The screen is preferably arcuate in at least one direction and each interconnection between adjacent first anodes and between adjacent second anodes comprises a resistive element.

In preferred embodiments of the present invention, there is provided means for dynamically varying a DC level applied to the anode means to align electrons emerging from the channels with the phosphor coating on the screen.

An aluminum backing may be included adjacent the phosphor coating.

The present invention further extends to a computer system comprising: memory means; data transfer means for transferring data to and from the memory means; processor means for processing data stored in the memory means; and a display device as hereinbefore described for displaying data processed by the processor means.

Furthermore, the present invention extends to a print-head comprising an electron source as hereinbefore described. Still furthermore, the present invention extends to document processing apparatus comprising such a print-head and means for supplying data to the print-head to produce a printed record in dependence on the data.

Viewing the present invention from another aspect, there is now provided a method for generating electron beams comprising: generating, in each of a plurality of channels extending between opposite poles of a magnet, a magnetic field which forms electrons received from a cathode means into an electron beam for guidance towards a target; controlling flow of electrons from the cathode means into each channel via grid electrode means disposed between the cathode means and the magnet; and positioning a magnetic field null region of each magnetic field at a location remote from the grid electrode means.

The positioning step preferably comprises spacing the grid electrode means from the surface of the magnet.

The positioning step may alternatively comprise tapering the entrance to each channel, the end of the taper having the largest surface area facing the cathode means.

Alternatively, the positioning step may comprise non-uniformly orienting magnetic domains within the magnet.

The positioning step may alternatively comprise disposing a layer of high magnetic permeability material on the surface of the magnet facing the cathode means.

In another alternative, the positioning step comprises forming the grid electrode means at least partially from a high magnetic permeability material.

BRIEF DESCRIPTION OF THE DRAWINGS

Preferred embodiments of the present invention will now be described, by way of example only, with reference to the accompanying drawings, in which.

DETAILED DESCRIPTION OF THE PREFERRED EMBODIMENTS OF THE INVENTION

Figure 1:
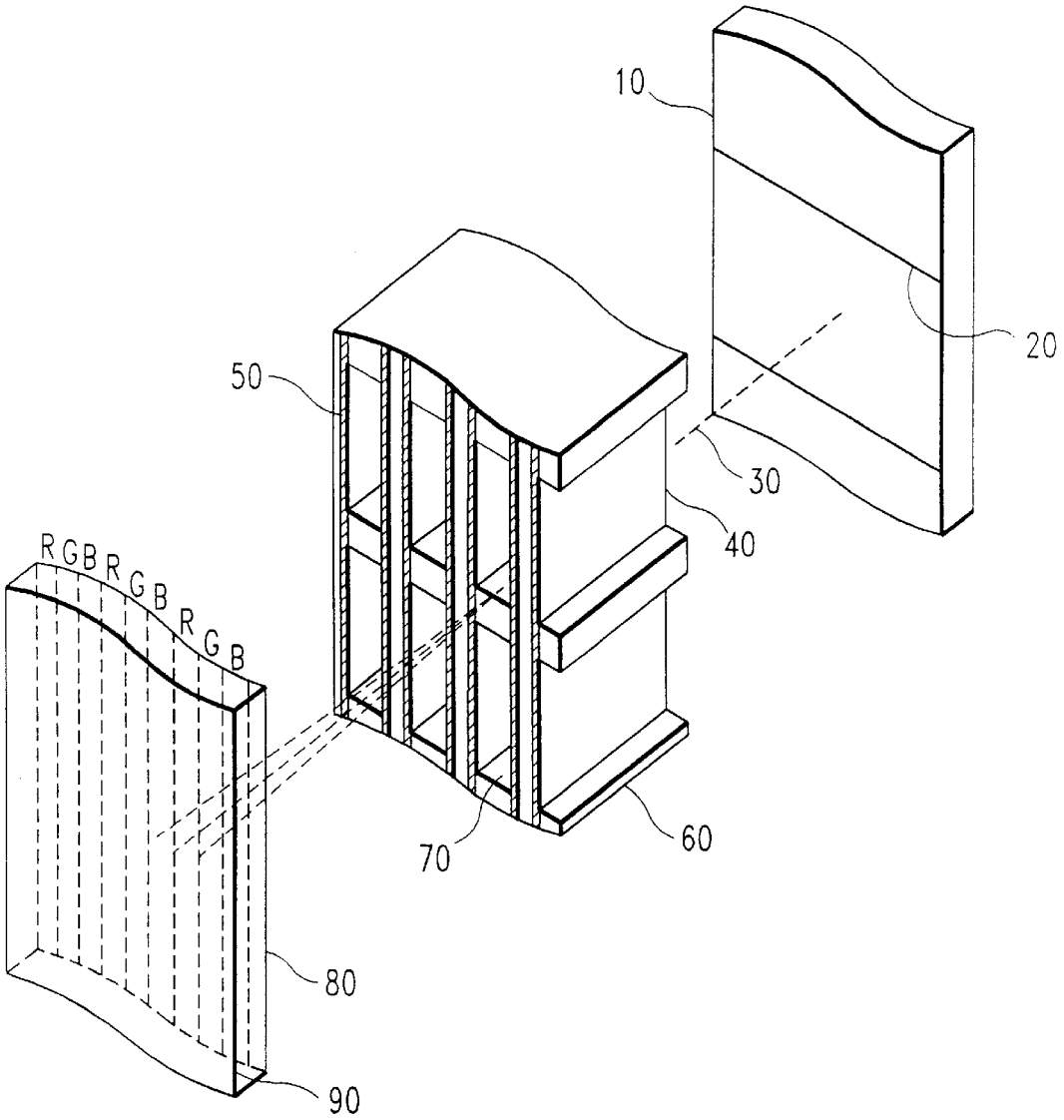
FIG. 1 is an exploded diagram of display apparatus embodying the present invention.

Referring first to FIG. 1, a color magnetic matrix display of the present invention comprises: a first glass plate 10 carrying a cathode 20 and a second glass plate 90 carrying a coating of sequentially arranged red, green and blue phosphor stripes 80 facing the cathode 20. The phosphors are preferably high voltage phosphors. A final anode layer (not shown) is disposed on the phosphor coating 80. A permanent magnet 60 is disposed between glass plates 90 and 10. The magnet is perforated by a two dimension matrix of perforation or "pixel wells" 70. An array of anodes 50 are formed on the surface of the magnet 60 facing the phosphors 80. For the purposes of explanation of the operation of the display, this surface will be referred to as the top of the magnet 60. There is a pair of anodes 50 associated with each column of the matrix of pixel wells 70. The anode of each pair extend along opposite sides of the corresponding column of pixel wells 70. A control grid 40 is formed on the surface of the magnet 60 facing the cathode 20. For the purposes of explanation of the operation of the display, this surface will be referred to as the bottom of the magnet 60. The control grid 40 comprises a first group of parallel control grid conductors extending across the magnet surface in a column direction and a second group of parallel control grid conductors extending across the magnet surface in a row direction so that each pixel well 70 is situated at the intersection of different combination of a row grid conductor and a column grid conductor. As will be described later, plates 10 and 90, and magnet 60 are brought together, sealed and then the whole is evacuated. In operation, electrons are released from the cathode and attracted towards control grid 40.

Control grid 40 provides a row/column matrix addressing mechanism for selectively admitting electrons to each pixel well 70. Electrons pass through grid 40 into an addressed pixel well 70. In each pixel well 70, there is an intense magnetic field. The pair of anodes 50 at the top of pixel well 70 accelerate the electrons through pixel well 70 and provide selective sideways deflection of the emerging electron beam 30. Electron beam 30 is then accelerated towards a higher voltage anode formed on glass plate 90 to produce a high velocity electron beam 30 having sufficient energy to penetrate the anode and reach the underlying phosphors 80 resulting in light output. The higher voltage anode may typically be held at 10 kV.

Figure 2A:
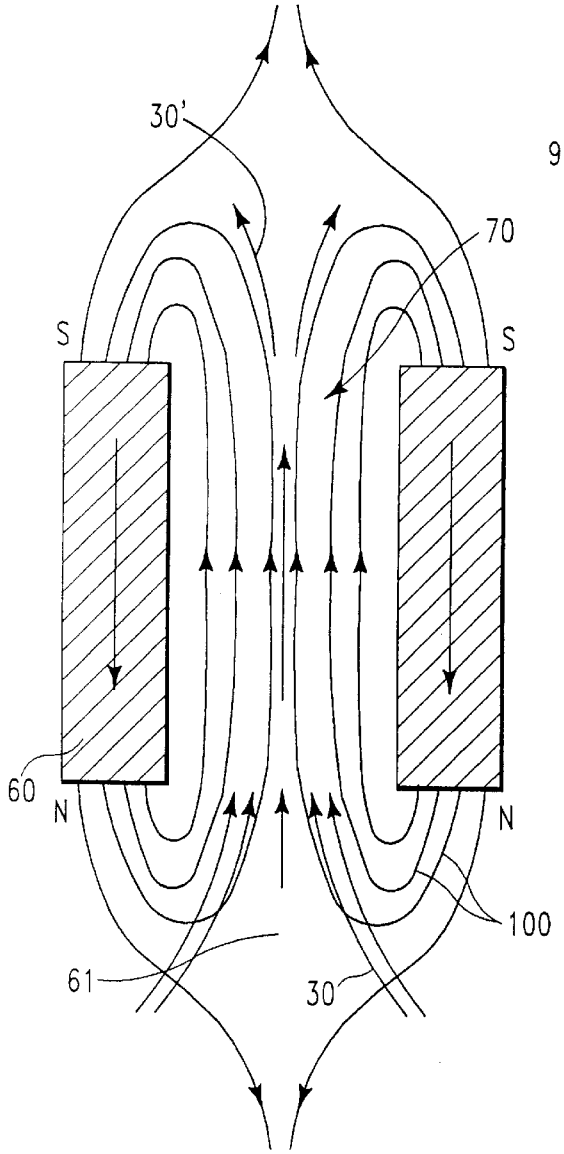
FIG. 2A is a cross-section view through a well of an electron source embodying the present invention to show magnetic field orientation.
Figure 2B:
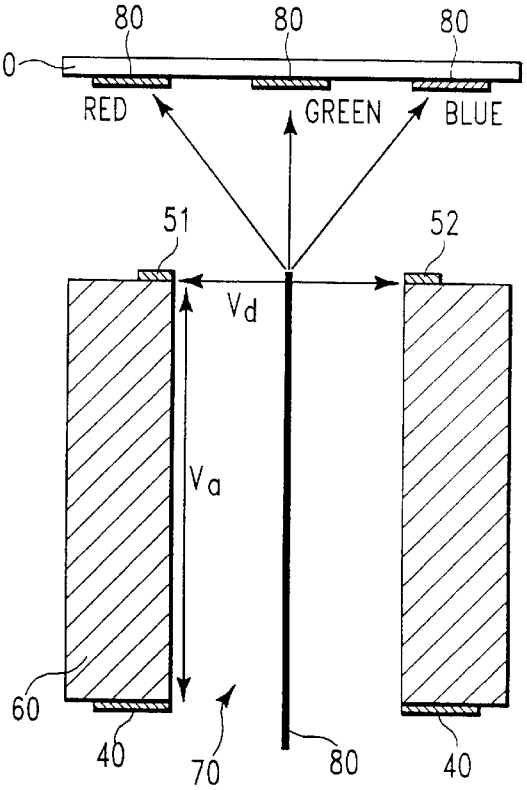
FIG. 2B is a cross-section view through a well of an electron source embodying the present invention to show electric field orientation.

What follows is a description of the device physics associated with a display of the present invention, in which the following quantities and equations are used:

Charge on an electron: $1.6\times10^{-19}$C
Energy of 1 electron-volt: $1.6\times10^{-19}$J
Rest mass of 1 electron: $9.108\times10^{-31}$Kg
Electron velocity: $v=(2eV/m)^{1/2}$ m/s
Electron kinetic energy: $mv^2/2$
Electron momentum: mv
Cyclotron frequency: f=qB/(2.pi.m) Hz FIG. 2A shows a simplified representation of magnetic fields with associated electron trajectories passing though pixel well 70. FIG. 2B shows a representation of electrostatic fields with associated electron trajectories passing through pixel well 70. An electrostatic potential is applied between the top and bottom of magnet 60 which has the effect of attracting electrons through the magnetic field shown at 100. There is a null point in the magnetic field at 61. Cathode 20 may be a hot cathode or a field emission tip array or other convenient source of electrons, such as a semiconducting material.

At the bottom of the magnetic field 100, by the entrance to pixel well 70, the electron velocity is relatively low (1 eV above the cathode work function represents an electron velocity of around $6\times10^5$ m/s). Electrons 30' in this region can be considered as forming a cloud, with each electron traveling in its own random direction. As the electrons are attracted by the electrostatic field their vertical velocity increases. If an electron is moving in exactly the same direction as the magnetic field 100 there will be no lateral force exerted upon it. The electron will therefore rise through the vacuum following the electric field lines. However, in the more general case the electron direction will not be in the direction of the magnetic field.

Referring now to FIG. 2B, magnetic force acting on a moving electron is perpendicular to both the magnetic field and the velocity of the electron (Flemings right hand rule or $F=e(E+v\times B)$). Thus, in the case of a uniform magnetic field only, the electron will describe a circular path. However, when the electron is also being accelerated by an electric field, the path becomes helical with the diameter of the helix being controlled by the magnetic field strength and the electrons x,y velocity. The periodicity of the helix is controlled by the electrons vertical velocity. A good analogy of this behavior is that of a cork in a whirlpool or dust in a tornado.

By way of summary, electrons enter magnetic field B 100 at the bottom of magnet 60, accelerate through well 70 in magnet 60, and emerge at the top of magnet 60 in a narrow but diverging beam.

Considering now the display as whole rather than a single pixel, the magnetic field B 100 shown in FIG. 2 is formed by a channel or pixel well 70 through a permanent magnet 60. Each pixel requires a separate pixel well 70. Magnet 60 is the size of the display area and is perforated by a plurality of pixel wells 70.

Figure 3:
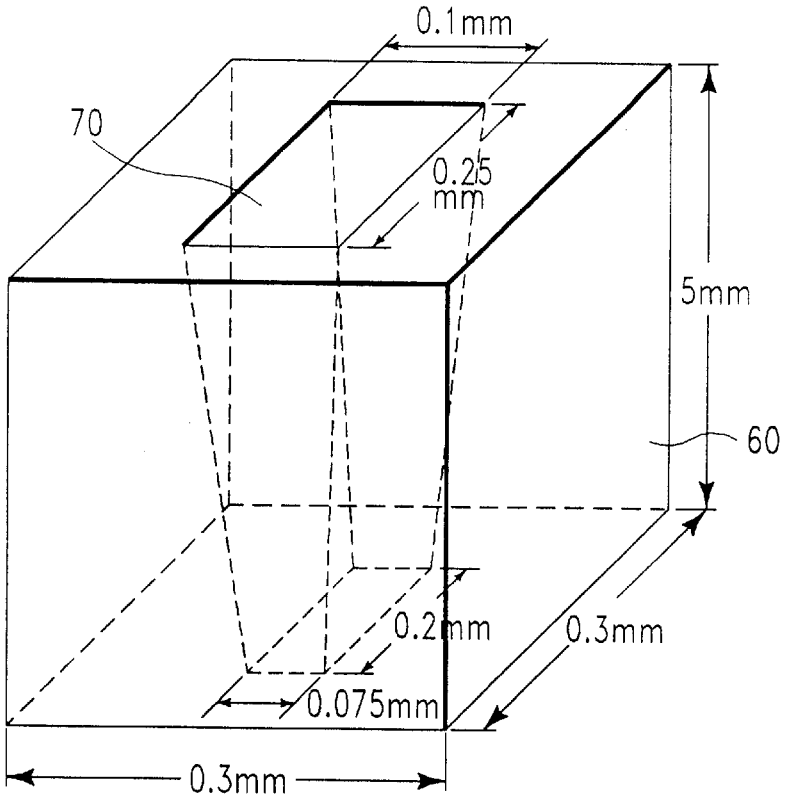
FIG. 3 is an isometric view of a well of an electron source embodying the present invention.

Referring now to FIG. 3, the magnetic field intensity in well 70 is relatively high; the only path for the flux lines to close is either at the edge of magnet 60 or through wells 70. Wells 70 may be tapered, with the narrow end of the taper adjacent cathode 20. It is in this region that the magnetic field is strongest and the electron velocity lowest. Thus efficient electron collection is obtained.

Figure 4A:
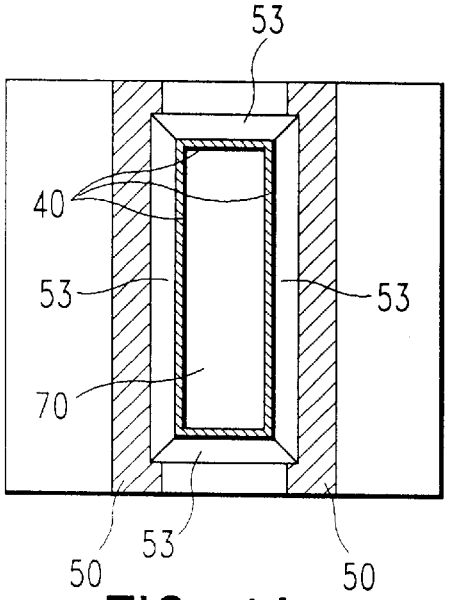
FIG. 4A is a plan view of a well of an electron source embodying the present invention.
Figure 4B:
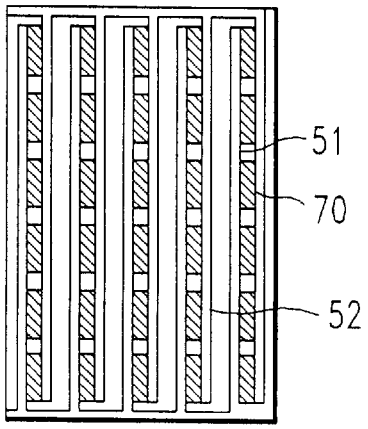
FIG. 4B is a plan view of a plurality of wells of an electron source embodying the present invention.

Referring back to FIG. 2B, electron beam 30 is shown entering an electrostatic field E. As an electron in the beam moves through the field, it gains velocity and momentum. The significance of this increase in the electrons momentum will be discussed shortly. When the electron nears the top of magnet 60, it enters a region influenced by deflection anodes 50. Assuming, for the purpose of discussion only, an anode voltage of 1 kV and a cathode voltage of 0 V, the electron velocity at this point is $1.875\times10^7$ m/s or approximately 6% of the speed of light. At the final anode, where the electron velocity is $5.93\times10^7$ m/s or 0.2 c, since the electron has then moved through 10 kV. Anodes 51 and 52 on either side of the exit from the pixel well 70 may be individually controlled. Referring now to FIGS. 4A and 4B, anodes 51 and 52 are preferably arranged in a comb configuration in the interests of easing fabrication. Anodes 51 and 52 are separated from well 70 and grid 40 by insulating regions 53. There are four possible states for anodes 51 and 52, as follows.

1. Anode 51 is OFF; Anode 52 is OFF: In this case there is no accelerating voltage $V_a$ between the cathode 20 and the anodes 51 and 52. This state is not used in normal operation of the display.
2. Anode 51 is ON; Anode 52 is ON: In this case there is accelerating voltage $V_a$ symmetrically about the electron beam. The electron beam path is unchanged. When leaving the control anode region the electrons continue until they strike the Green phosphor.
3. Anode 51 is OFF; Anode 52 is ON: In this case there is an asymmetrical control anode voltage $V_d$. The electrons are attracted towards the energized anode 52 (which is still providing an accelerating voltage relative to the cathode 20). The electrons beam is thus electrostatically deflected towards the Red phosphor.

4. Anode 51 is ON; Anode 52 is OFF: This is the opposite to 3. above. In this case, the electron beam is deflected towards the Blue phosphor.

It will be appreciated that other sequences of phosphors may be deposited on the screen with corresponding data re-ordering.

It should also be appreciated that the above deflection technique does not change the magnitude of the electron energy. In some embodiments of the present invention, the anode voltage may be less 1 kV. In some cases, the anode voltage may between 100 V and 200 V.

As described above, electron beam 30 is formed as electrons move through magnet 60. The magnetic field B 100, although decreasing in intensity still exists above the magnet and in the region of anodes 50. Thus, operation of anodes 50 also requires that they have sufficient effect to drive electron beam 30 at an angle through magnetic field B 100. The momentum change of the electron between the bottom and top of well 70 is of the order of 32× (for a 1 KV anode voltage). The effect of the divergent magnetic field B 100 may be reduced between the bottom and top by a similar amount.

Individual electrons tend to continue traveling in a straight line. However, there are three forces tending to disperse electron beam 30, as follows:

1. The diverging magnetic field B 100 tends to cause electron beam 30 to diverge due to the $V_{xy}$ distribution;
2. The electrostatic field E tends to deflect electron beam 30 towards itself; and,
3. Space charge effects within beam 30 itself cause some divergence.

Figure 5A:
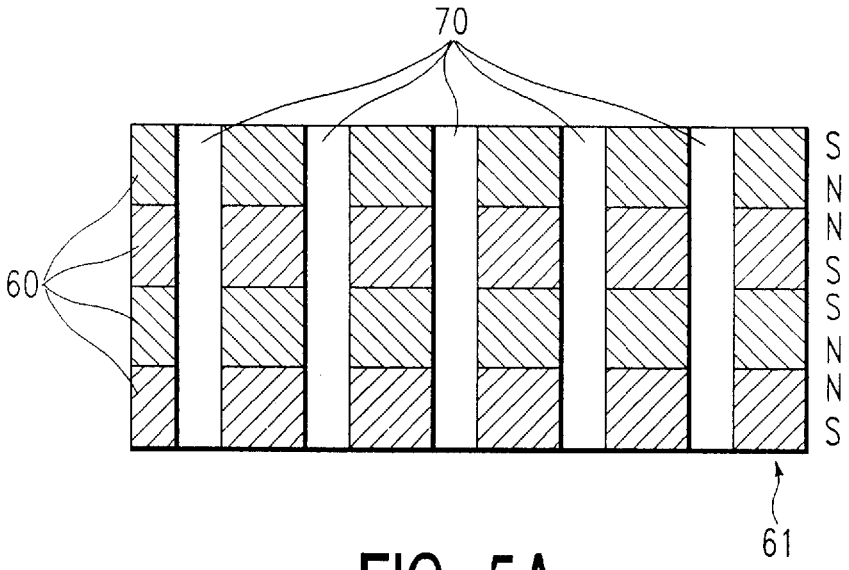
FIG. 5A is a cross section of a stack of magnets of an electron source embodying the present invention.
Figure 5B:
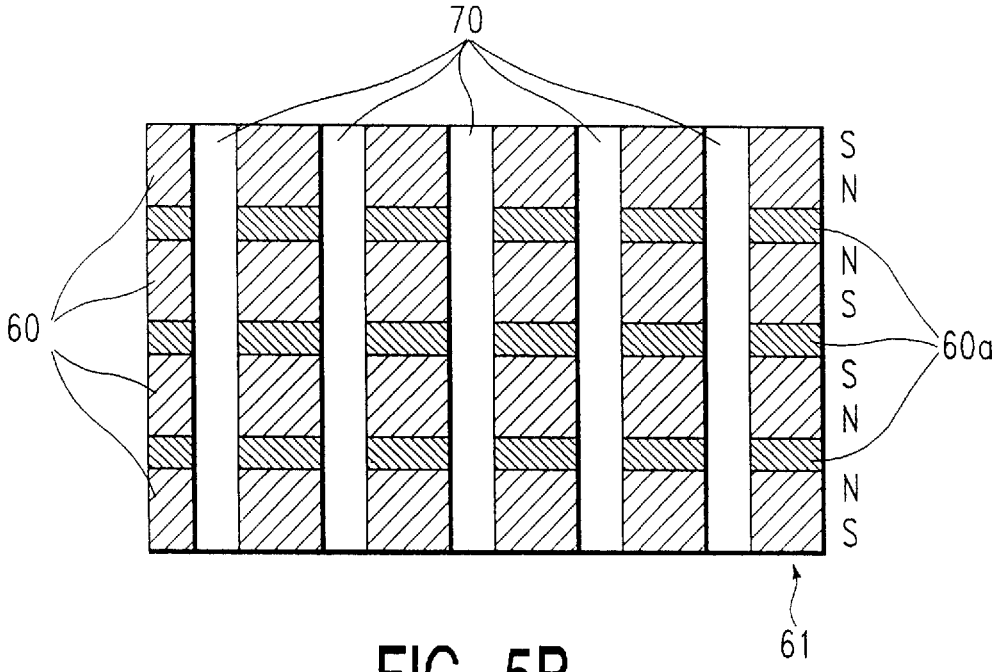
FIG. 5B is a cross section of another stack of magnets of an electron source embodying the present invention.

Referring now to FIG. 5A, in a modification to the example of the preferred embodiment of the present invention hereinbefore described, magnet 60 is replaced by a stack 61 of magnets 60 with like poles facing each other. This produces a magnetic lens in each well 70, thereby aiding beam collimation prior to deflection. This provides additional electron beam focusing. Furthermore, providing the stack 61 consists of one or more pairs of magnets, the helical motion of the electrons is canceled. Referring now to FIG. 5B, some embodiments of the present invention, spacers 60*a* may be inserted between magnets 60 to improve the lens effect of stack 61.

As mentioned earlier, the display has cathode means 20, grid or gate electrodes 40, and an anode. The arrangement can thus be regarded as a triode structure. Electron flow from cathode means 20 is regulated by grid 40 thereby controlling the current flowing to the anode. It should be noted that the brightness of the display does not depend on the velocity of the electrons but on the quantity of electrons striking phosphor 80.

As mentioned above, magnet 60 acts as a substrate onto which the various conductors required to form the triode are deposited. Deflection anodes 50 are deposited on the top face of magnet 60 and control grid 40 is fabricated on the bottom surface of the magnet 60. Referring back to FIG. 3, it will be appreciated that the dimensions of these conductors are relatively large compared with those employed in current flat panel technologies such as liquid crystal or field emission displays for example. The conductors may advantageously be deposited on magnet 60 by conventional screen printing techniques, thereby leading to lower cost manufacture compared with current flat panel technologies.

Referring back to FIG. 4, deflection anodes 50 are placed on either side of well 70. In the example hereinbefore described, an anode thickness of 0.01 mm provided acceptable deflection. However, larger dimensions may be used with lower deflection voltages. Deflection anodes 50 may also be deposited to extend at least partially into pixel well 70. It will be appreciated that, in a monochrome example of a display device of the present invention, anode switching or modulation is not required. The anode width is selected to avoid capacitive effects introducing discernable time delays in anode switching across the display. Another factor affecting anode width is current carrying capacity, which is preferably sufficient that a flash-over doe not fuse adjacent anodes together and thus damage the display.

In an embodiment of the present invention preferred for simplicity, beam indexing is implemented by alternately switching drive voltages to deflection anodes 50. Improved performance is obtained in another embodiment of the present invention by imposing a modulation voltage on deflection anodes 50. The modulation voltage waveform can be one of many different shapes. However, a sine wave is preferable to reduce back emf effects due to the presence of the magnetic field.

Cathode means 20 may include an array of field emission tips or field emission sheet emitters (amorphous diamond or silicon for example). In such cases, the control grid 40 may be formed on the field emission device substrate. Alternatively, cathode means 20 may include plasma, hot area, hot emitter, or thin film metal insulator metal (MIM) cathodes, in which cases control grid 40 may be formed on the bottom surface of the magnet as hereinbefore described. An advantage of the ferrite block magnet is that the ferrite block can act as a carrier and support for all the structures of the display that need precision alignment, and that these structures can be deposited by low grade photolithography or screen printing. In yet another alternative embodiment of the present invention, cathode means 20 comprises a photocathode.

As mentioned above, control grid 40 controls the beam current and hence the brightness. In some embodiments of the present invention, the display may be responsive to digital video alone, i.e.: pixels either on or off with no grey scale. In such cases, a single grid 40 provides adequate control of beam current. The application of such displays are however limited and, generally, some form of analog, or grey scale, control is desirable. Thus, in other embodiments of the present invention, two grids are provided; one for setting the black level or biassing, and the other for setting the brightness of the individual pixels. Such a double grid arrangement may also perform matrix addressing of pixels where it may be difficult to modulate the cathode.

A display of the present invention differs from a conventional CRT display in that, whereas in a CRT display only one pixel at a time is lit, in a display of the present invention a whole row or column is lit. Another benefit of the display of the present invention resides in the utilization of row and column drivers. Whereas a typical LCD requires a driver for each of the Red, Green and Blue channels of the display, a display of the present invention uses a single pixel well 70 (and hence grid) for all three colors. Combined with the aforementioned beam-indexing, this means that the driver requirement is reduced by a factor of 3 relative to a comparable LCD. A further advantage is that, in active LCDs, conductive tracks must pass between semiconductor switches fabricated on the screen. Since the tracks do not emit light, their size must be limited so as not to be visible to a user. In displays of the present invention, all tracks are hidden either beneath phosphor 80 or on the underside of magnet 60. Due to the relatively large spaces between adjacent pixel wells 70, the tracks can be made relatively large. Hence capacitance effects can be easily overcome.

The relative efficiencies of phosphors 80 at least partially determines the drive characteristics of the gate structure. One way to reduce the voltages involved in operating a beam indexed system is to change the scanning convention. In a preferred embodiment of the present invention, rather than the usual scan of R G B R G B, . . . , the scan is organized so that the most inefficient phosphor is placed in between the two more efficient phosphors in a phosphor stripe pattern. Thus, if the most inefficient phosphor is, for example, Red, the scan follows the pattern B R G R B R G R . . ..

In a preferred embodiment of the present invention, a standing DC potential difference is introduced across deflection anodes 50. The potential can be varied by potentiometer adjustment to permit correction of any residual misalignment between phosphors 80 and pixel wells 70. A two dimensional misalignment can be compensated by applying a varying modulation as the row scan proceeds from top to bottom.

Figure 6A:
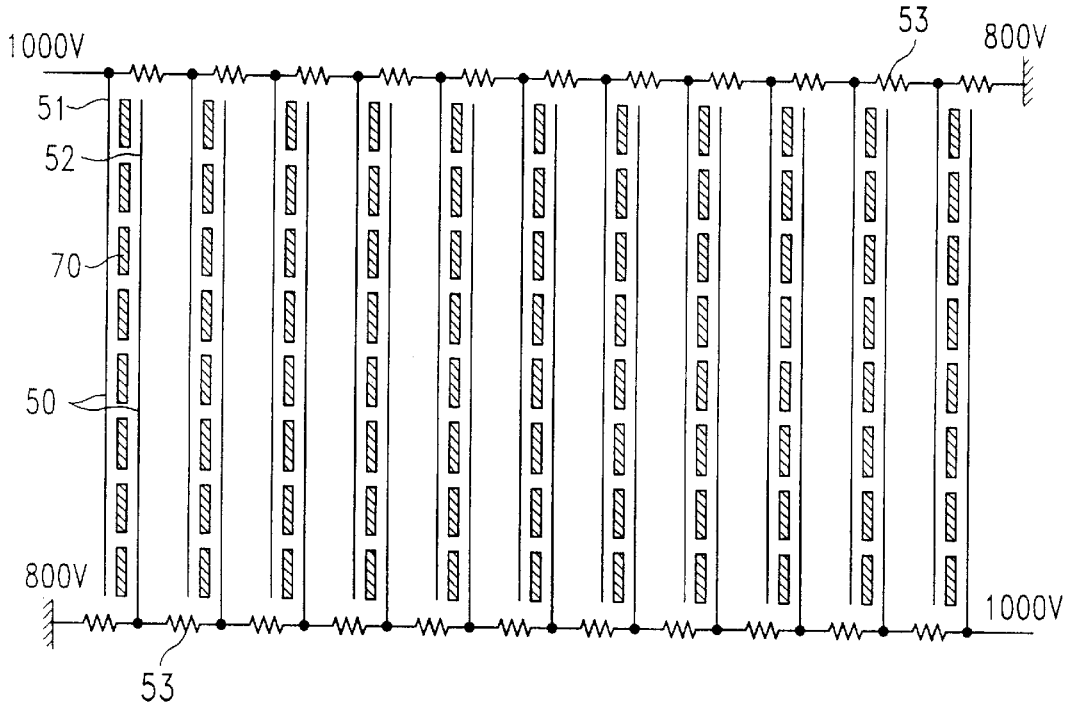
FIG. 6A, is a plan view of a display embodying the present invention.
Figure 6B:
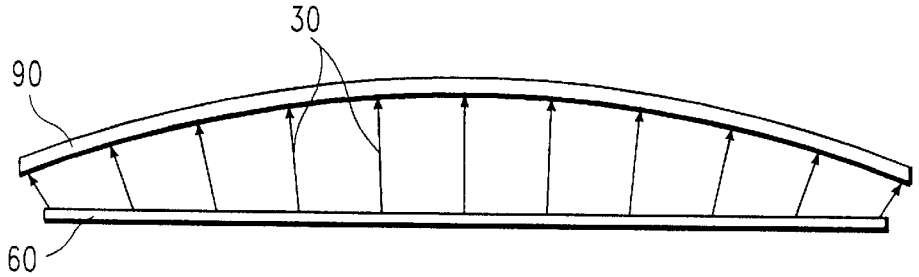
FIG. 6B, is a cross section through the display of FIG. 6A.

Referring now to FIG. 6A, in a preferred embodiment of the present invention, resistive elements 53 between deflection anodes 50 are made resistive. This introduces a slightly different DC potential from the center to the edge of the display. The electron trajectory thus varies gradually in angle as shown in FIG. 6B. This permits a flat magnet 60 to be combined with non-flat glass 90 and, in particular, cylindrical glass. Cylindrical glass is preferable to flat glass because it relieves mechanical stress under atmospheric pressure. Flat screens tend to demand extra implosion protection when used in vacuum tubes.

In a preferred embodiment of the present invention, color selection is performed by beam indexing. To facilitate such beam indexing, the line rate is 3 times faster than normal and the R, G, and B line is multiplexed sequentially. Alternatively, the frame rate may be 3 times faster than usual and field sequential color is employed. It should be appreciated that field-sequential scanning may produce objectionable visual effects to an observer moving relative to the display. Important features of a display of the present invention include the following.

1. Each pixel is generated by a single pixel well 70.
2. The color of a pixel is determined by a relative drive intensity applied to each of the three primary colors.
3. Phosphor 80 is deposited on faceplate 90 in stripes.
4. Primary colors are scanned via a beam index system which is synchronized to the grid control.
5. An electron beam is used to excite high voltage phosphors.
6. Grey-scale is achieved by control of the grid voltage at the bottom of each pixel well (and hence the electron beam density).
7. An entire row or column is addressed simultaneously.
8. If required, the least efficient phosphor 80 can be double scanned to ease grid drive requirements.
9. Phosphor 80 is held at a constant DC voltage.

The above features may provide considerable one or more of the following advantages over conventional flat panel displays.

1. The pixel well concept reduces overall complexity of display fabrication.
2. Whereas in a CRT display, only about 11% of the electron beam current exits the shadow mask to excite the phosphor triads, in a display of the present invention the electron beam current at or near to 100% of the beam current is utilized for each phosphor stripe it is directed at by the beam indexing system. An overall beam current utilization of 33% is achievable, 3 times that achievable in a conventional CRT display.
3. Striped phosphors prevent Moire interference occurring in the direction of the stripes.
4. Control structures and tracks for the beam index system can be easily accommodated in a readily available area on top of the magnet, thereby overcoming a requirement for narrow and precise photolithography as is inherent in conventional LCDs.
5. High voltage phosphors are well understood and readily available.
6. The grid voltage controls an analog system. Thus the effective number of bits for each color is limited only by the DAC used to drive grid 40. Since only one DAC per pixel well row is involved, and the time available for digital to analog conversion is very long, higher resolution in terms of grey-scale granularity is commercially feasible. Thus, the generation of "true color" (24 bits or more) is realizable at relatively low cost.
7. As with conventional LCDs, a display of the present invention uses a row/column addressing technique. Unlike conventional CRT displays however, the excitation time of the phosphor is effectively one third of the line period, e.g.: between 200 and 530 times longer than that for a CRT display for between 600 and 1600 pixels per line resolution. Even greater ratios are possible, especially at higher resolutions. The reason for this is that line and frame flyback time necessary when considering conventional CRT display are not needed for displays of the present invention. The line flyback time alone for a conventional CRT display is typically 20% of the total line period. Furthermore front and back porch times are redundant in displays of the present invention, thereby leading to additional advantage. Further benefits include:
   a) Only one driver per row/column is required ( conventional color LCDs need three);
   b) Very high light outputs are possible. In a conventional CRT display, the phosphor excitation time is much shorter than it's decay time. This means that only one photon per site is emitted during each frame scan. In a display of the present invention, the excitation time is longer than the decay period and so multiple photons per site are emitted during each scan. Thus, a much greater luminous output can be achieved. This is attractive both for projection applications and for displays to be viewed in direct sunlight.
   c) The grid switching speeds are fairly low. It will be appreciated that, in a display of the present invention, the conductors formed on the magnet are operating in a magnetic field. Thus, the conductor inductance gives rise to an unwanted EMF. Reducing the switching speeds reduces the EMF, and also reduces stray magnetic and electric fields.
8. The grid drive voltage is related to the cost of the switching electronics. CMOS switching electronics offers a cheap possibility, but CMOS level signals are also invariably lower than those associated with alternative technologies such as bipolar, for example. Double scanning, e.g.: splitting the screen in half and scanning the 32 halves in parallel, as is done in LCDs, thus provides an attractively cheap drive technology. Unlike in LCD technology however, double scanning in a display of the present invention doubles the brightness.
9. In low voltage FEDs, phosphor voltages are switched to provide pixel addressing. At small phosphor strip pitches, this technique introduces significant electric field stress between the strips. Medium or higher resolution FEDs may not therefore be possible without risk of electrical breakdown. In displays of the present invention however, the phosphors are held at a single DC final anode voltage as in a conventional CRT display. In preferred embodiments of the present invention, an aluminum backing is placed on the phosphors to prevent charge accumulation and to improve brightness. The electron beams are sufficiently energetic to penetrate the aluminum layer and cause photon emission from the underlying phosphor.

Figure 7:
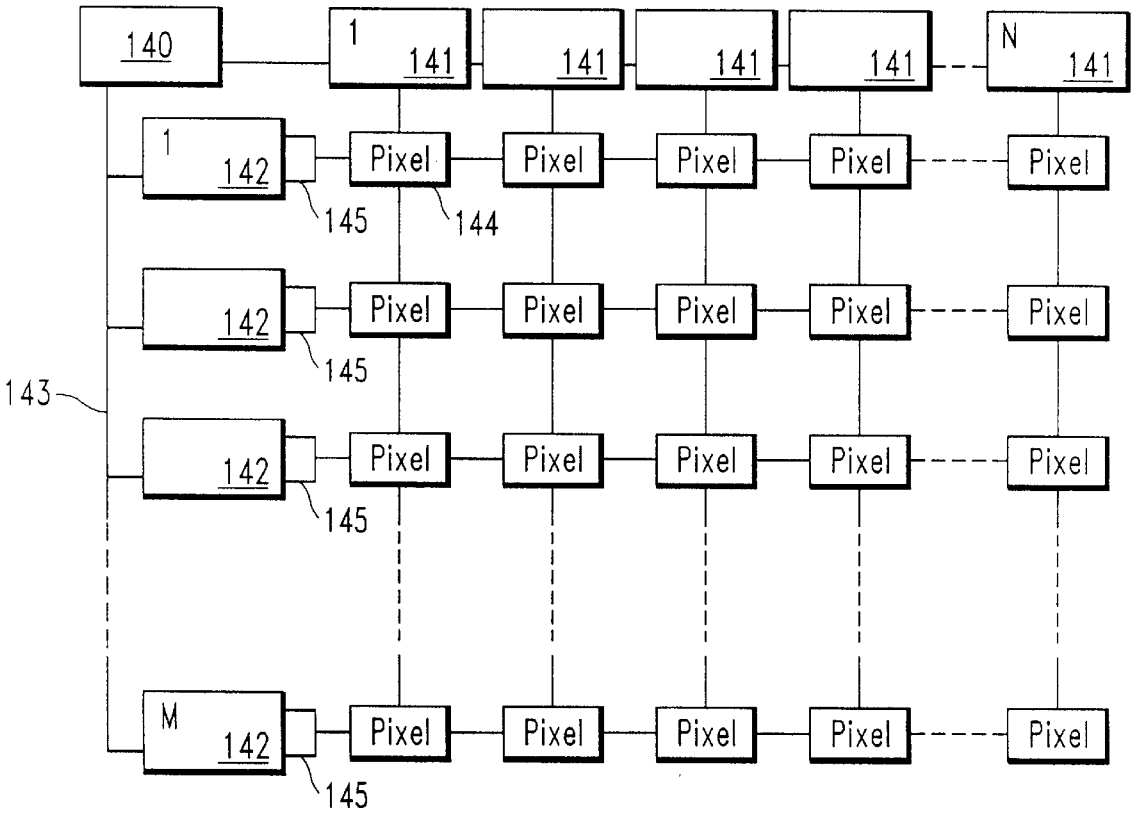
FIG. 7, is a block diagram of an addressing system for a display embodying the present invention.

Referring now to FIG. 7, a preferring matrix addressing system for an N×M pixel display of the present invention comprises an n bit data bus 143. A data bus interface 140 receives input red, green, and blue video signals and places them on data bus in an n bit digital format, where p of each n bits indicates which of the M rows the n bits is addressed to. Each row is provided with an address decoder 142 connected to a q bit DAC, where p+q=n. In preferred embodiments of the present invention, q=8. The output of each DAC is connected to a corresponding row conductor of grid 40 associated with a corresponding row of pixels 144. Each column is provided with a column driver 141. The output of each column driver 141 is connected to corresponding column conductor of grid 40 associated with a corresponding column of pixels 144. Each pixel 144 is thus located at the intersection of a different combination of row and column conductors of grid 40.

Figure 8:
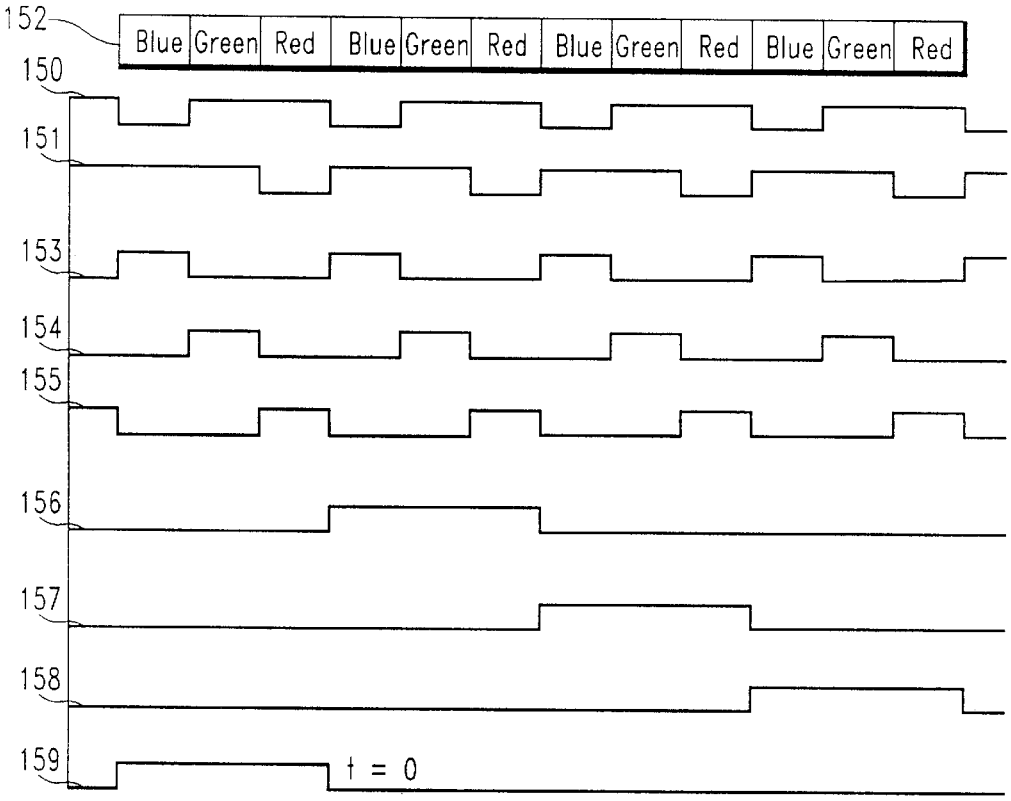
FIG. 8 is a timing diagram corresponding to the addressing system of FIG. 7.

Referring now to FIG. 8, in operation, anodes 51 and 52 are energized with waveforms 150 and 151 respectively to scan electron beam 30 from each pixel well 70 across Red, Green and Blue phosphor stripes 80 in the order shown at 152. Red, Green and Blue video data, represented by waveforms 153, 154, and 155, is sequentially gated onto the row conductors in synchronization with beam indexing waveforms 150 and 151. Column drivers 1, 2, 3 and N generate waveforms 156, 157, 158, and 159 respectively to sequentially select each successive pixel in given row.

Figure 9:
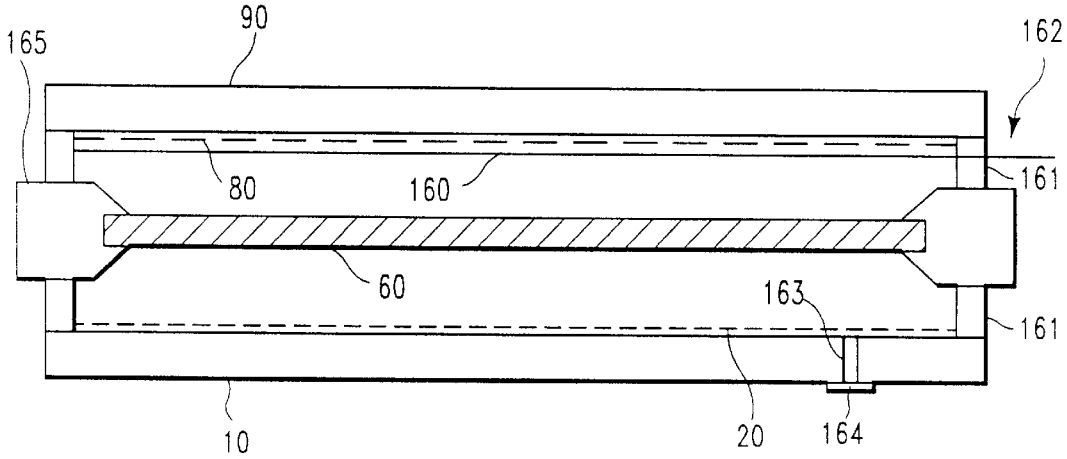
FIG. 9 is a cross section through a display embodying the present invention in operation.

Referring now to FIG. 9, in a preferred embodiment of the present invention in which cathode means 20 is provided by field emission devices. Magnet 60 is supported by glass supports through which connections to the row and column conductors of grid 40 are brought out. A connection 162 to the final anode 160 is brought out via glass side supports 161. The assembly is evacuated during manufacture via exhaust hole 163 which is subsequently capped at 164. A getter may be employed during evacuation to remove residual gases. In small, portable displays of the present invention, faceplate 90 may be sufficiently thin that spacers are fitted to hold faceplate 90 level relative to magnet 60. In larger displays, faceplate 90 can be formed from thicker, self-supporting glass.

In general, there is a small number of residual gas atoms in the evacuated space of a cathode ray tube device. Electrons traveling within such devices may collide with the residual gas atoms. The velocity of the electrons may be such that the collision may create secondary electrons and positive heavy ions. Heavy ions are accelerated and attracted to negative potentials. Furthermore, because of their relative heavy mass, heavy ions can cause material damage if accelerated by a significantly high potential. In a conventional cathode ray tube, heavy ions can be accelerated towards the cathode. However, the path of the heavy ions is circuitous. The ions rarely hit the cathode. However, the ions can impact the metal parts of the electron gun. This can release sufficient material to initiate a flash-over within the cathode ray tube. In display devices embodying the present invention, the voltages in the cathode/well region are relatively low. Therefore, ions do not reach sufficient velocity to cause damage. However, in the region between the screen/magnet region, there is an accelerating potential difference of the order of 10 kV. Ions will be accelerated in this region towards magnet 60. Such ions may impact the surface of magnet 60 and/or anodes 50, causing erosion of material and potentially initiating a flashover. In a modification to the preferred embodiments of the present invention, the surface of magnet 60 carrying anodes 50, and anodes 50 themselves are coated with a material which is resistant to ion bombardment, such as an oxide with a high inter-atomic binding energy. An example of a such an oxide is Aluminum Oxide.

Examples of magnetic matrix displays employing the present invention have been hereinbefore described. It will now be appreciated that such displays employ a combination of electrostatic and magnetic fields to control the path of high energy electrons in a vacuum. Such displays have a number of pixels and each is generated by its own site within the display structure. Light output is produced by the incidence of electrons on phosphor stripes. Both monochrome and color displays are possible. An example of a color version uses a switched anode technique as hereinbefore described to perform beam indexing. It will also now be appreciated that the present invention is not limited to display technology in application and may be used in other technologies such as printer technology for example. In particular, it will be appreciated that the present invention can be arranged to act as a print head in document production and/or reproduction apparatus such as printers, copiers, or facsimile machines.

Figure 10:
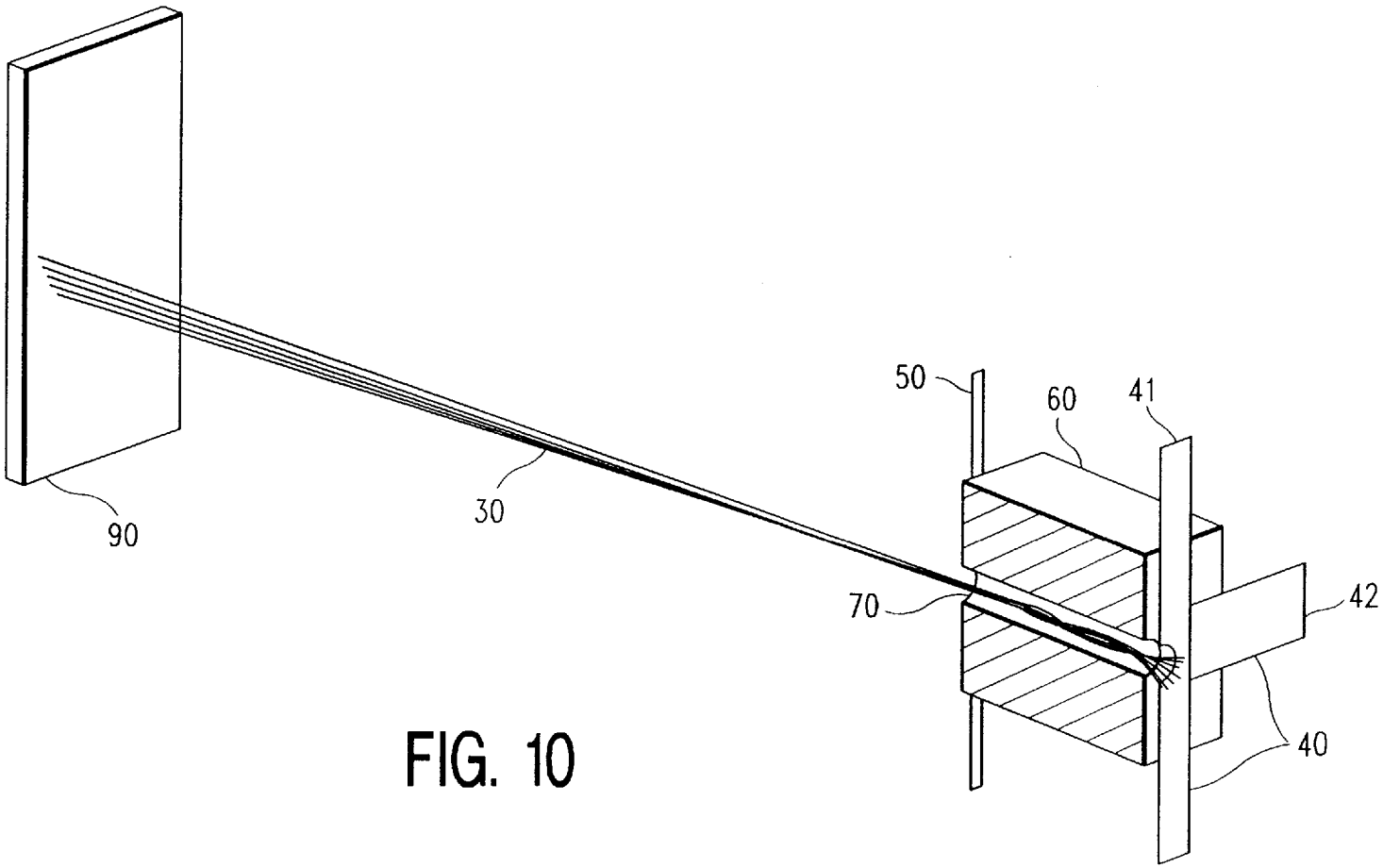
FIG. 10 is a cross section through a well of an electron source embodying the present invention in operation.

Referring to FIG. 10, by way of summary of the foregoing, an electron source embodying the present invention has a cathode 10 which, in use produces electrons. The electrons produced by cathode 10 are selected and collected by orthogonal grids 40. Selected and collected electrons are accelerated in a beam 30 towards a first anode 50. Without application of, for example, a focusing mechanism, beam 30 is divergent. However, in preferred embodiments of the present invention, there is provided a pixel well 70 formed in a permanent magnet 60 for collimating beam 30. Specifically, pixel well 70 contains an intense magnetic field. In operation, instead of diverging, electrons of beam 30 spiral around the magnetic field lines thereby collimating beam 30. Because the magnetic field extends beyond magnet 60, the collimation effect continues as beam 30 arrives at first anode 50 and accelerates onwards towards a target, such as a phosphor screen. The two orthogonal groups 41 and 42 of grid conductors 40 operate analogously to the Grid 1 an Grid 2 electrodes (typically referred to as G1 and G2) of a conventional canned beam cathode ray display tube.

Figure 11:
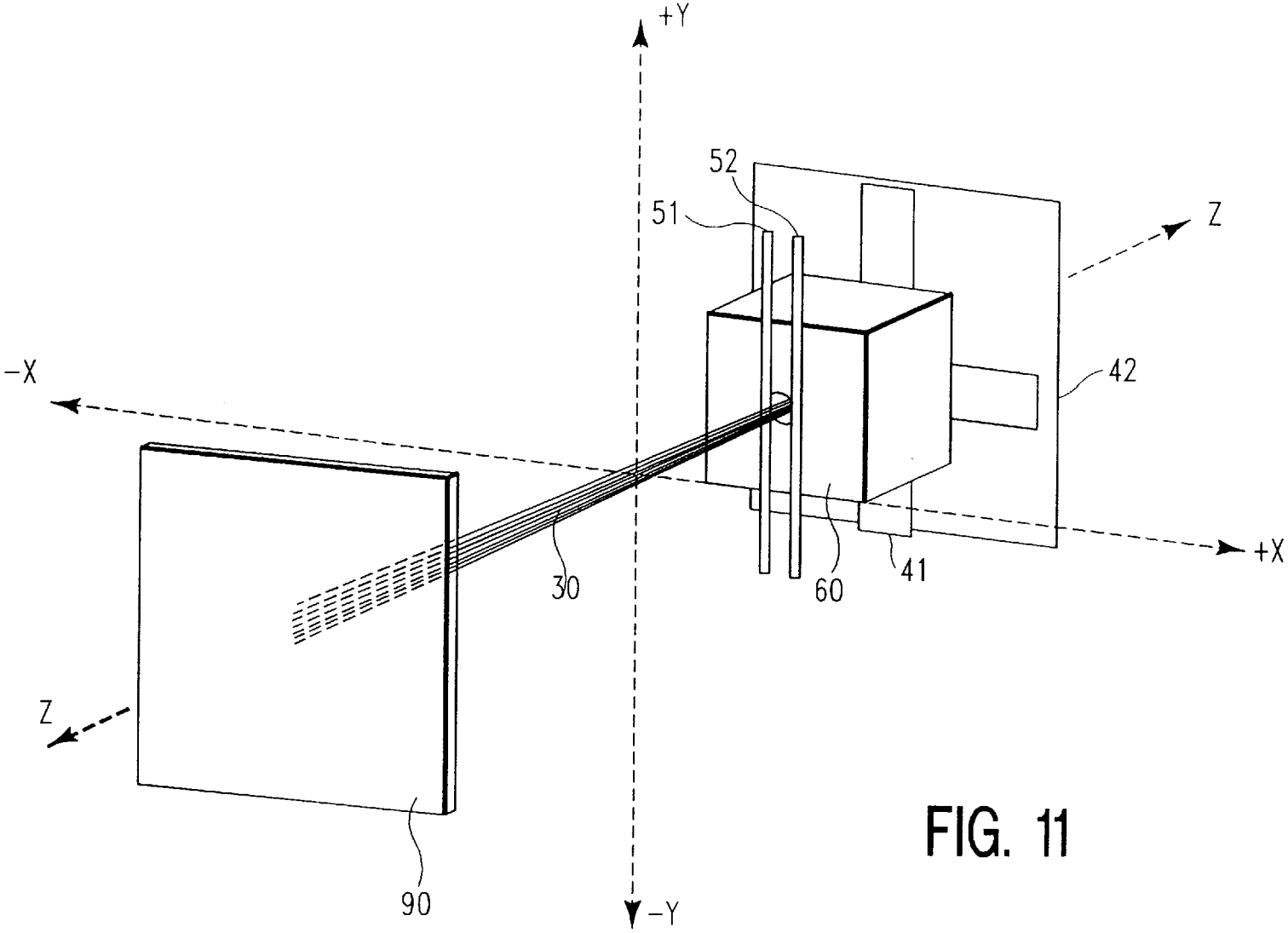
FIG. 11 is an isometric view of a well of an electron source of the present invention in operation.
Figure 12:
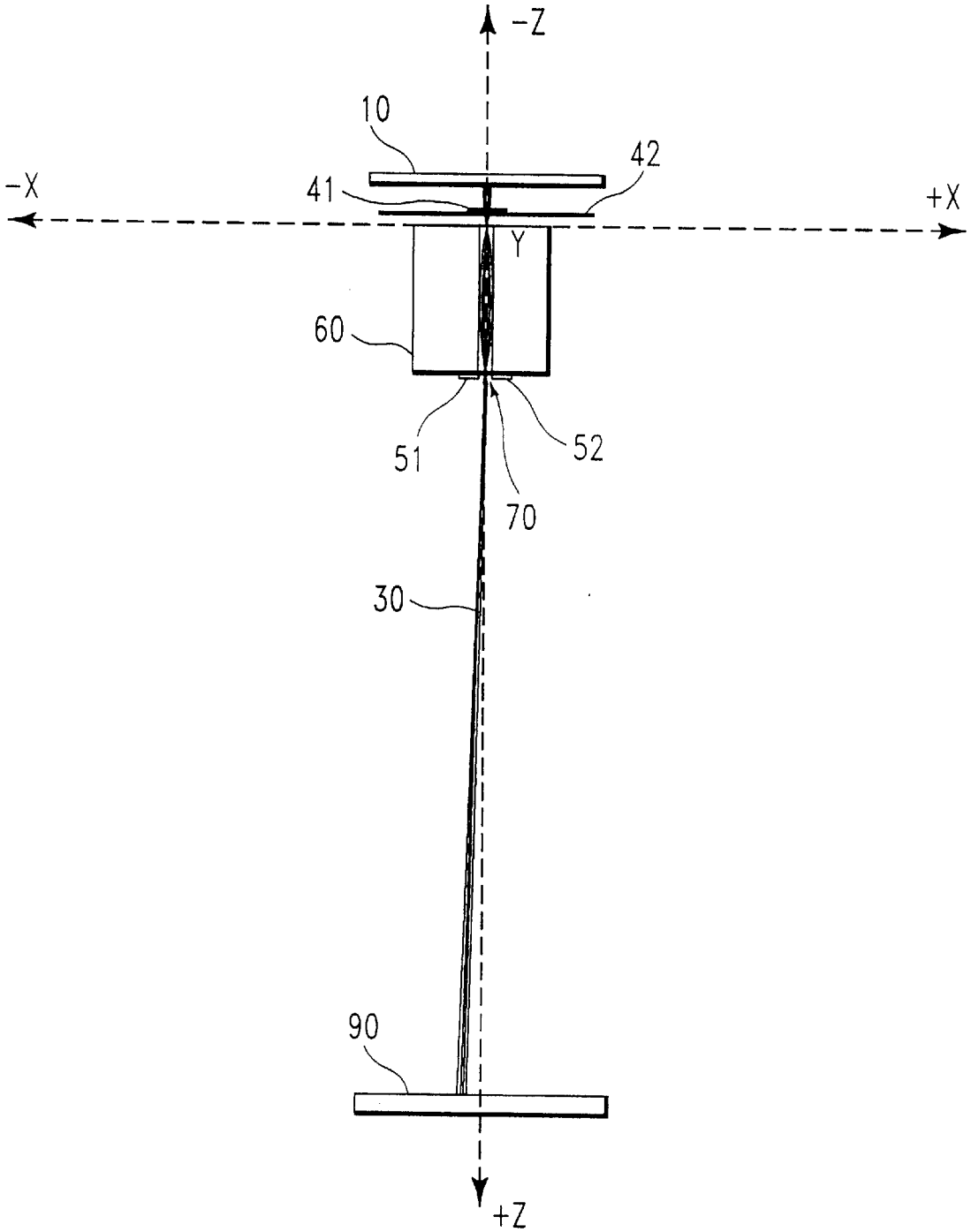
FIG. 12 is a plan view-of a well of an electron source of the present invention in operation.

The electron beam spot is formed by a combination of both electrostatic and magnetic fields. Referring now to FIG. 11, in a typical display based on an electron source as described in the preceding paragraph, magnet 60 may be lmm thick, and cathode 10 may be spaced 200 micrometers from grids 40. Typically, 100 V is applied to first anode 50, and 10 kV to screen 90. Referring to FIG. 12, if instead 75 V is applied to one anode strip 51 and 100 V is applied to the other anode strip 52, beam 30 is deflected to a different color phosphor stripe.

In FIGS. 13, 16, 18, and 20, all of which will be referred to shortly, the arrow-heads indicate the direction and intensity of magnetic force. The reference letters a–h employed in FIGS. 13, 16, 18 and 20, together with the key labeled "BZ/GAUSS", represents the distribution of magnetic field strength in the vicinity of pixel well 70.

Figure 13:
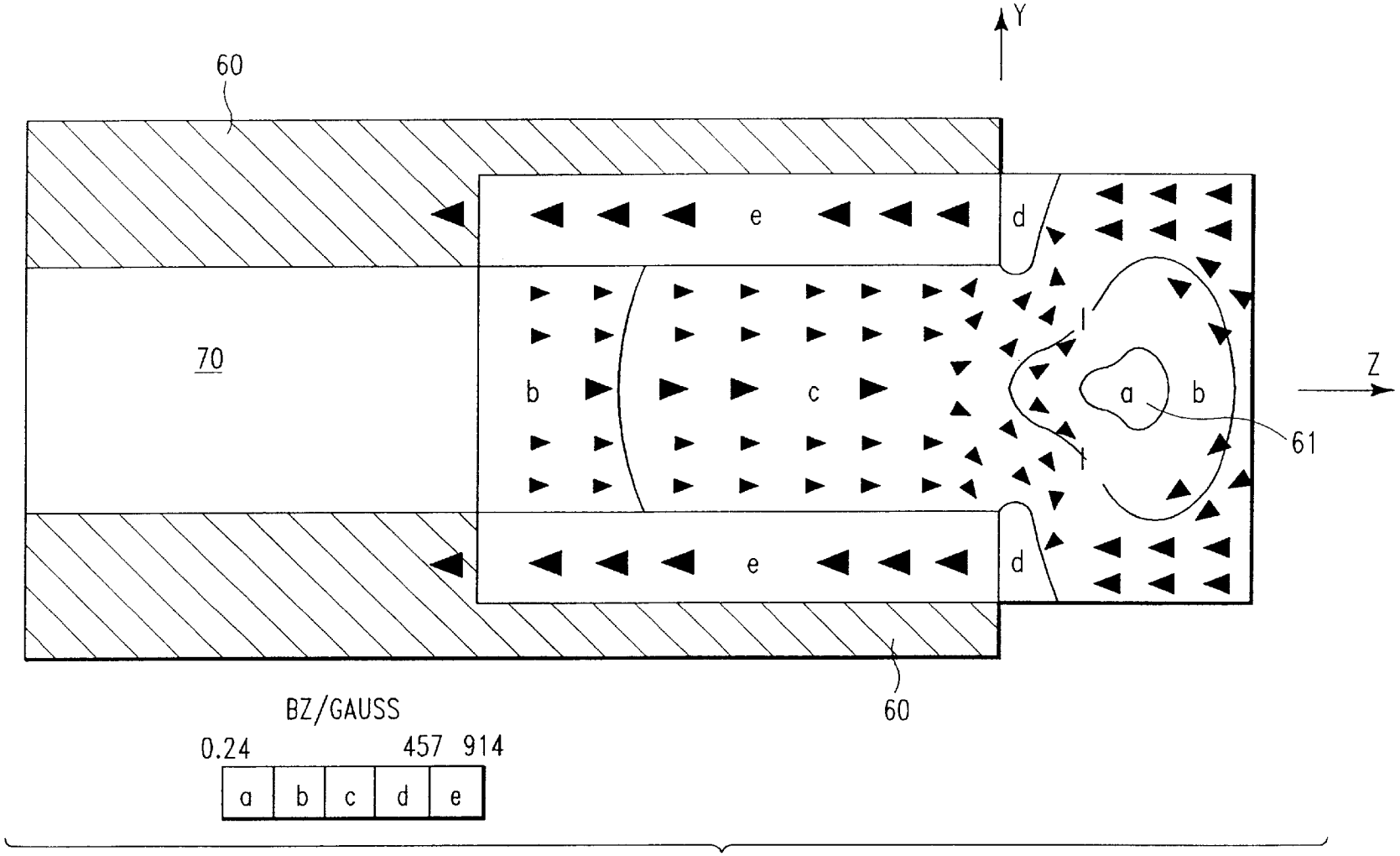
FIG. 13 is a cross sectional view through a well of an electron source of the present invention with the associated magnetic field distribution superimposed thereon.

With reference to FIG. 13, a problem with the electron sources hereinbefore described stems from the presence of the magnetic null region 61 exists at the entry to pixel well 70. Null region 61 disturbs the path of electrons into well 70. The disturbance can lead to electrons colliding with the walls of well 70 instead of collimating within well 70. Alternatively, null region 61 can divert electrons away from well 70 rather than collecting them.

Another problem with the electron sources hereinbefore described stems from a reduction in magnetic field intensity along the length of pixel well 70. This reduction causes an increase in diameter of the helical path of the electrons within well 70. The increase in diameter can lead to electrons impacting the walls of well 70 and hence losing beam current to phosphor stripes 80 and magnet 60.

A further problem with the electron sources hereinbefore described stems from space charge in the collimated electron beam 30'. The space charge would cause beam divergence in the absence of a magnetic field.

It will be appreciated from FIG. 13 that there is a region where the magnetic field B in the Z axis drops to zero, coupled with residual magnetic fields in the X and Y directions. This results in a change in the direction of field lines. The change is quantified in the magnetic field intensity graph of FIG. 14.

Figure 15:
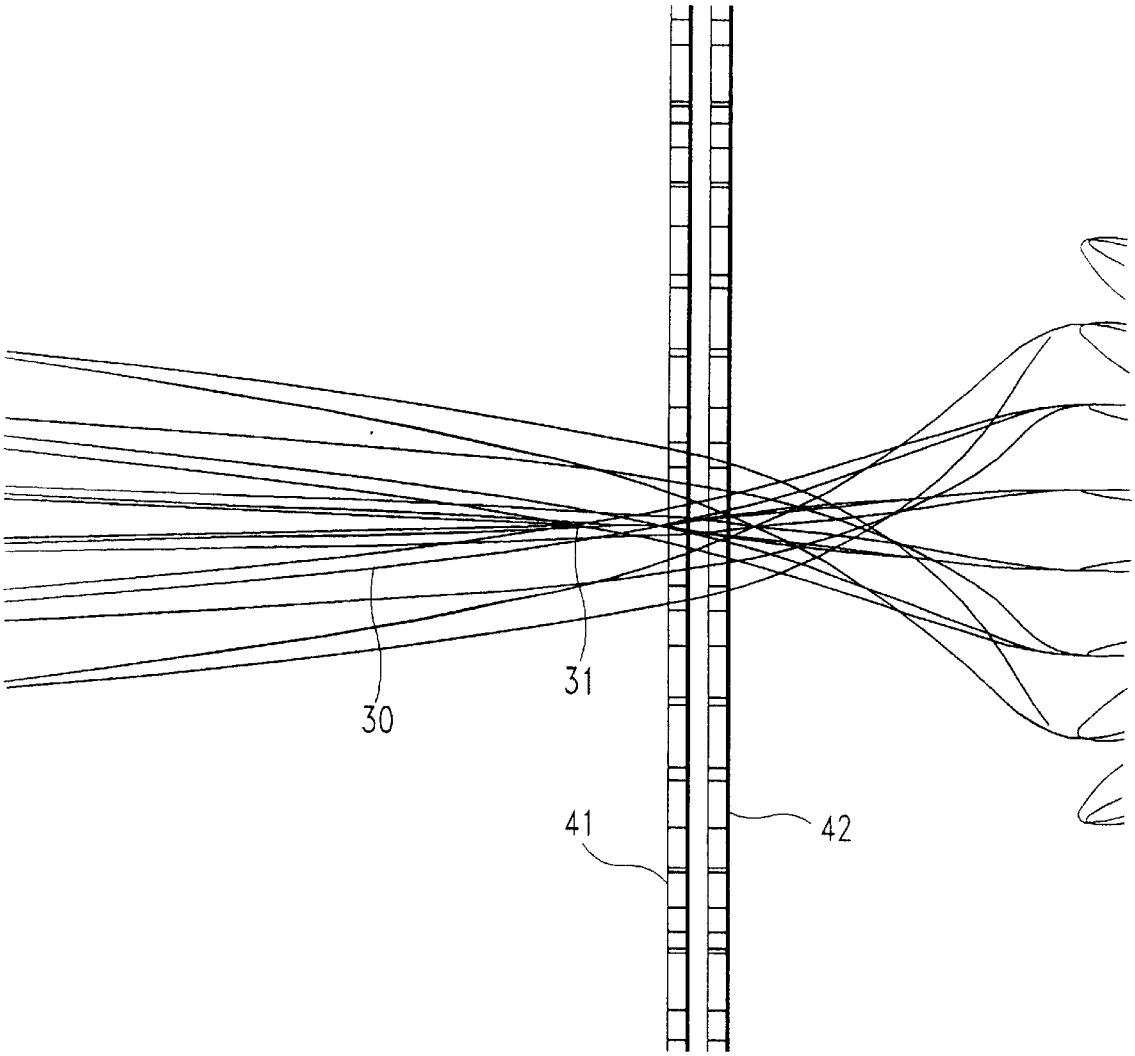
FIG. 15 is a plot of electron trajectories towards a well of an electron source embodying the present invention in the absence of a magnetic field.
Figure 16:
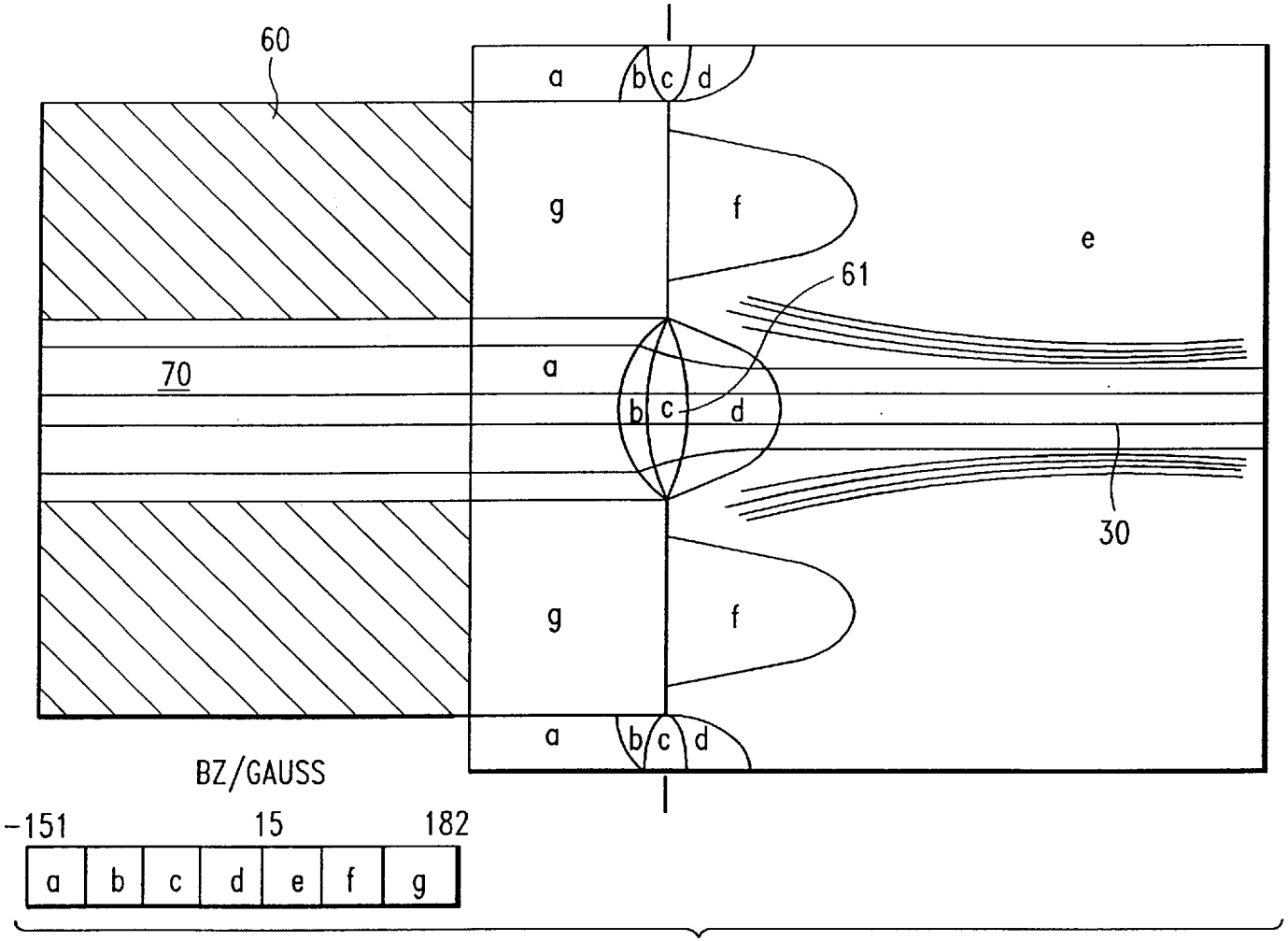
FIG. 16 is a cross sectional view through a well of an electron source of the present invention with the associated magnetic field distribution and electron trajectories superimposed thereon.

With reference to FIG. 15, in the region of cathode 20 and grids 40, in the absence of a magnetic field, electron beam 30 is collected by the electrostatic field and focused to sharp cross-over region 31 just beyond grids 40. However, when a permanent magnetic field is applied, the field vectors of the magnetic null region tend to deflect the electrons away from well 70. Whether or not the electrons tend to focus in, or are deflected away, depends on the relative strengths of the associated forces and electron velocities. However, in practice, the balance can act in favor of magnetic forces. With reference to FIG. 16, the electrons therefore tend to divert away from well 70.

In preferred embodiments of the present invention, there is provided a solution to the above problem. That solution is to effectively move the magnetic null region 61 in a direction away from the region of cathode 20 and grids 40 to a position just beyond grids 40.

Figure 17:
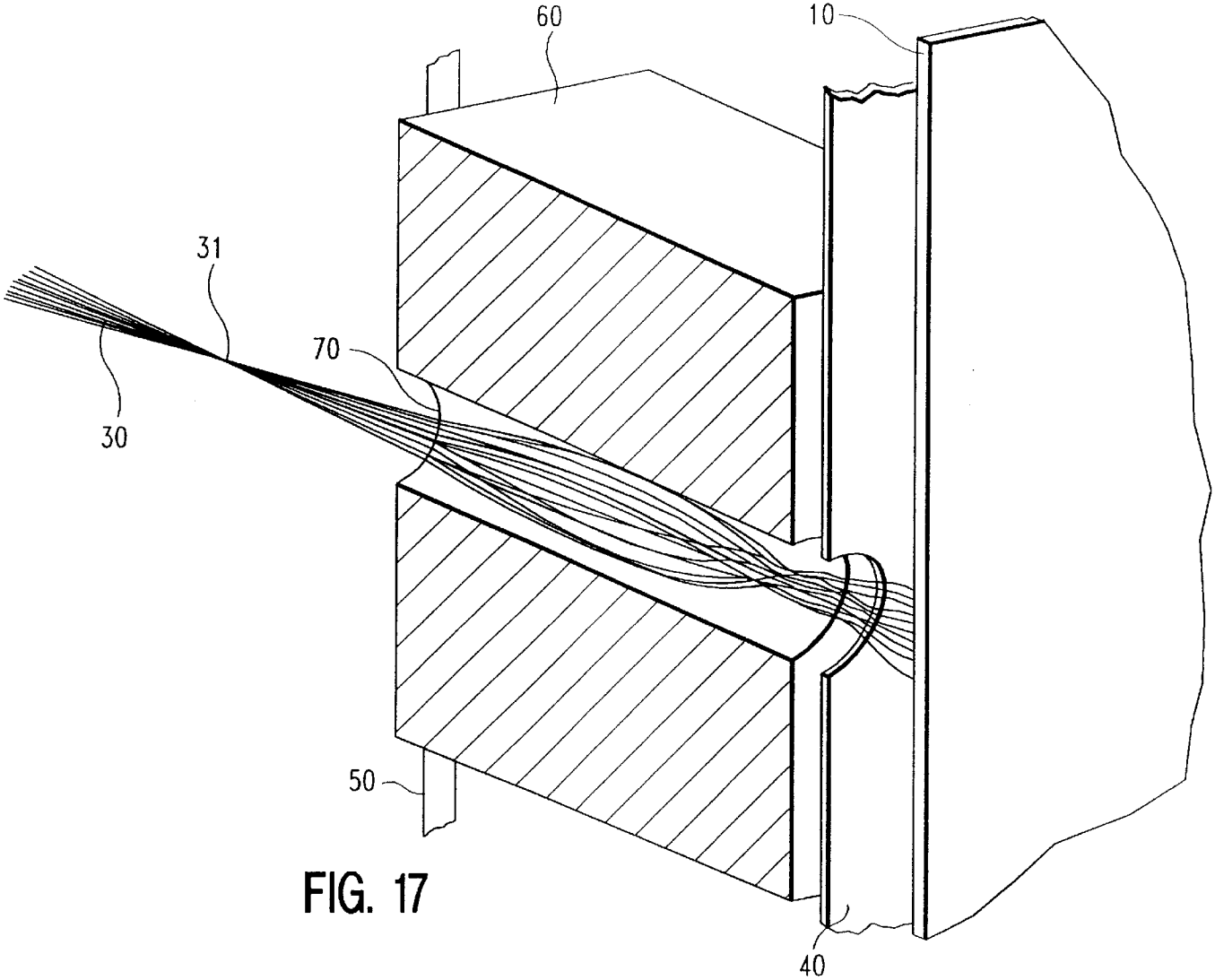
FIG. 17 is a cross-sectional view through a well of an electron source embodying the present invention with grid electrodes spaced from the well.

In a preferred embodiment of the present invention, null region 61 is moved from the cathode/grid region by spacing grids 40 from the entrance to well 70. FIG. 17 shows electron tracks in a combined electrostatic and magnetic field with grids 40 spaced at 100 micro meters from the surface of magnet 60. The electrons are correctly focused into the cross-over region 31. There is a residual disturbance created by null region 61 at the cross-over, but this is insufficient to prevent proper collimation in well 70.

Figure 18:
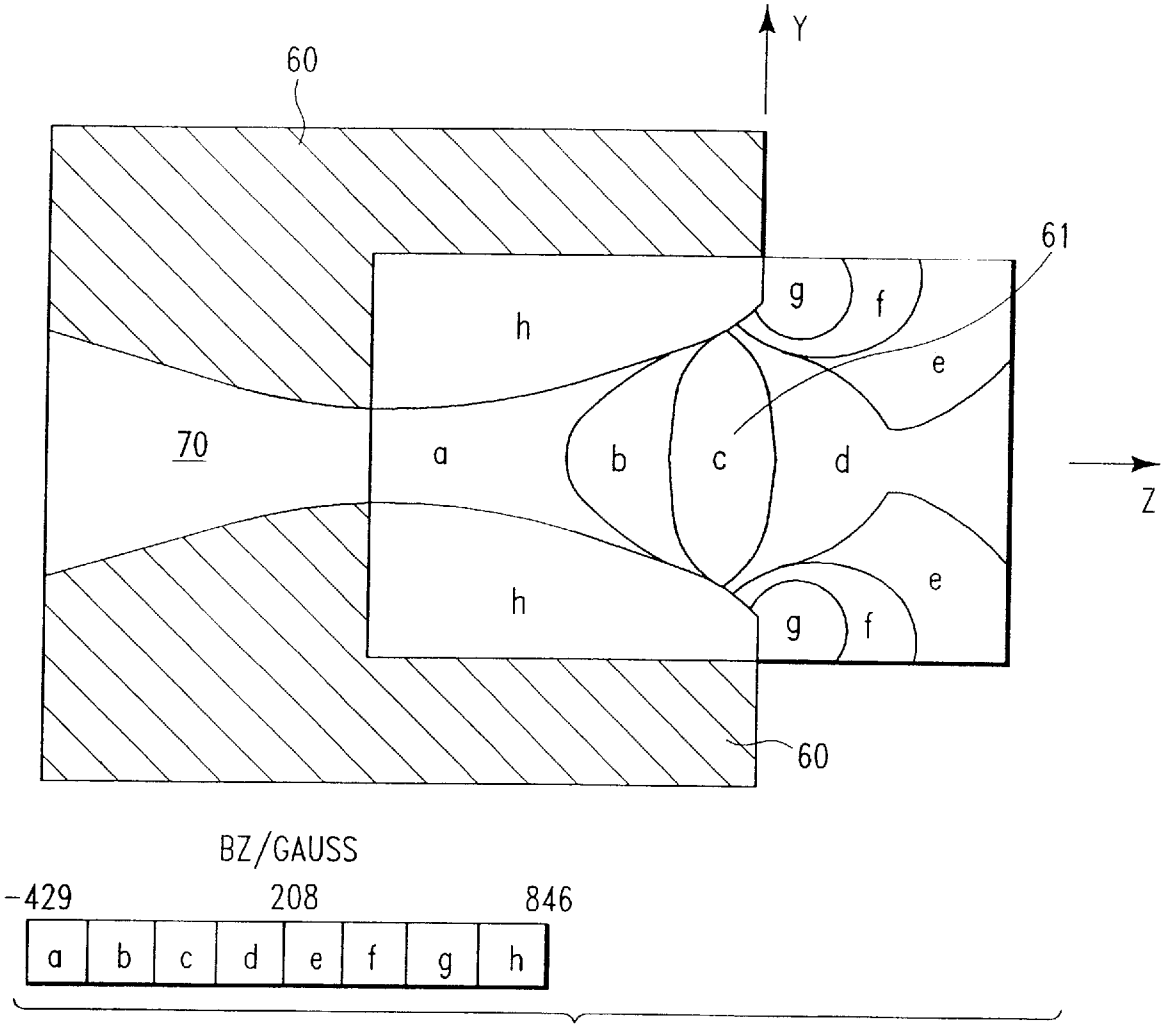
FIG. 18 is a cross-sectional view through a well of an electron source embodying the present invention with the entrance to the well tapered and the associated magnetic field distribution superimposed thereon.

In another preferred embodiment of the present invention, null region 61 is moved from the cathode/grid region by shaping magnet 60 such that null region 61 is positioned inside well 70. Referring to FIG. 18, in a particularly preferred embodiment of the present invention, this is achieved by tapering the opening to well 70. In the FIG. 18 embodiment, the pixel well is tapered at both ends. However, it will be appreciated that, in other embodiments of the present invention, only the entrance to well 70 may be tapered. The taper shapes the magnetic field so as to locate null region 61 inside well 70.

Figure 19A:
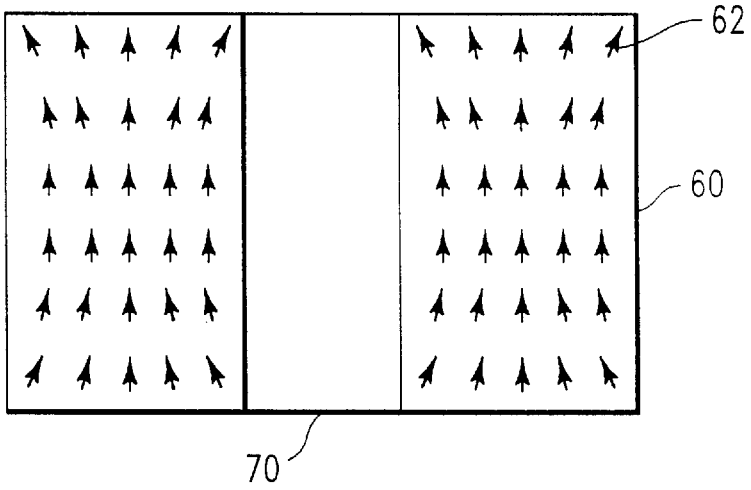
FIG. 19A is a cross sectional view of a well of an electron source embodying the present invention showing orientation of magnetic domains.
Figure 19B:
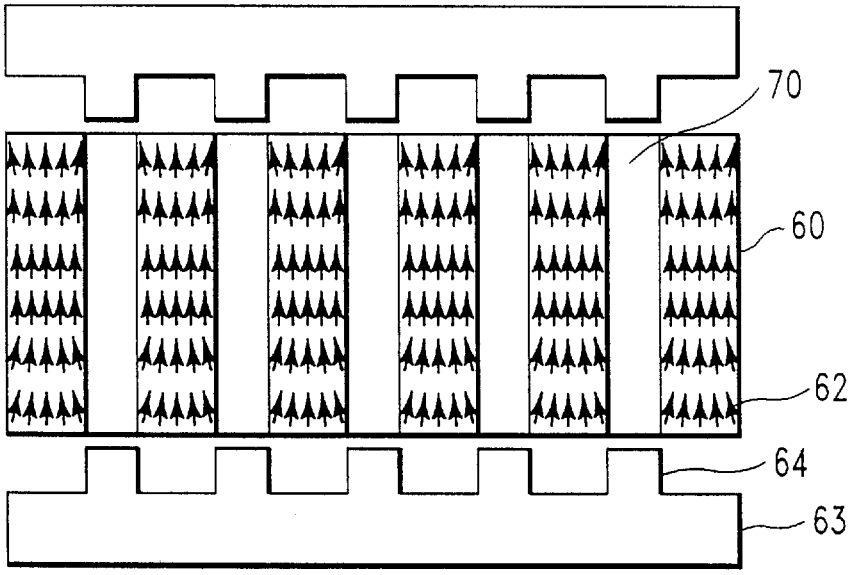
FIG. 19B is a cross sectional view of the magnet of an electron source of the present invention during manufacture.

In another embodiment of the present invention, the magnetic field is shaped so that null region 61 is located inside the pixel well. Referring to FIG. 19A, this is achieved by shaping the magnetic field inside magnet 60 to turn towards to the entrance to well 70. Such field shaping has the effect of locating null region 61 inside well 70. The shaping can be obtained by locally orienting the magnetic domains 62 of magnet 60 in the desired field direction. Referring now to FIG. 19B, In preferred embodiments of the present invention, magnet 60 is formed by magnetizing ferrite particles in a bonded or sintered structure. Domain orientation is achieved by introducing a strong magnetic field to the structure during manufacture. The desired domain orientation can be obtained by applying the magnetic field to the magnet when it is located in the vicinity of shaped iron formers 63. Iron formers 63 have formations 64 corresponding in location to the sites of pixel wells 70. Formations 64 tend to distort the orienting magnetic field in the regions of the openings to pixel wells 70 to produce the desired localized domain orientations. It will be appreciated that, in other embodiments of the present invention, the magnetic field inside the magnet may also be turned towards the exit of pixel wells 70 if desired.

Figure 20:
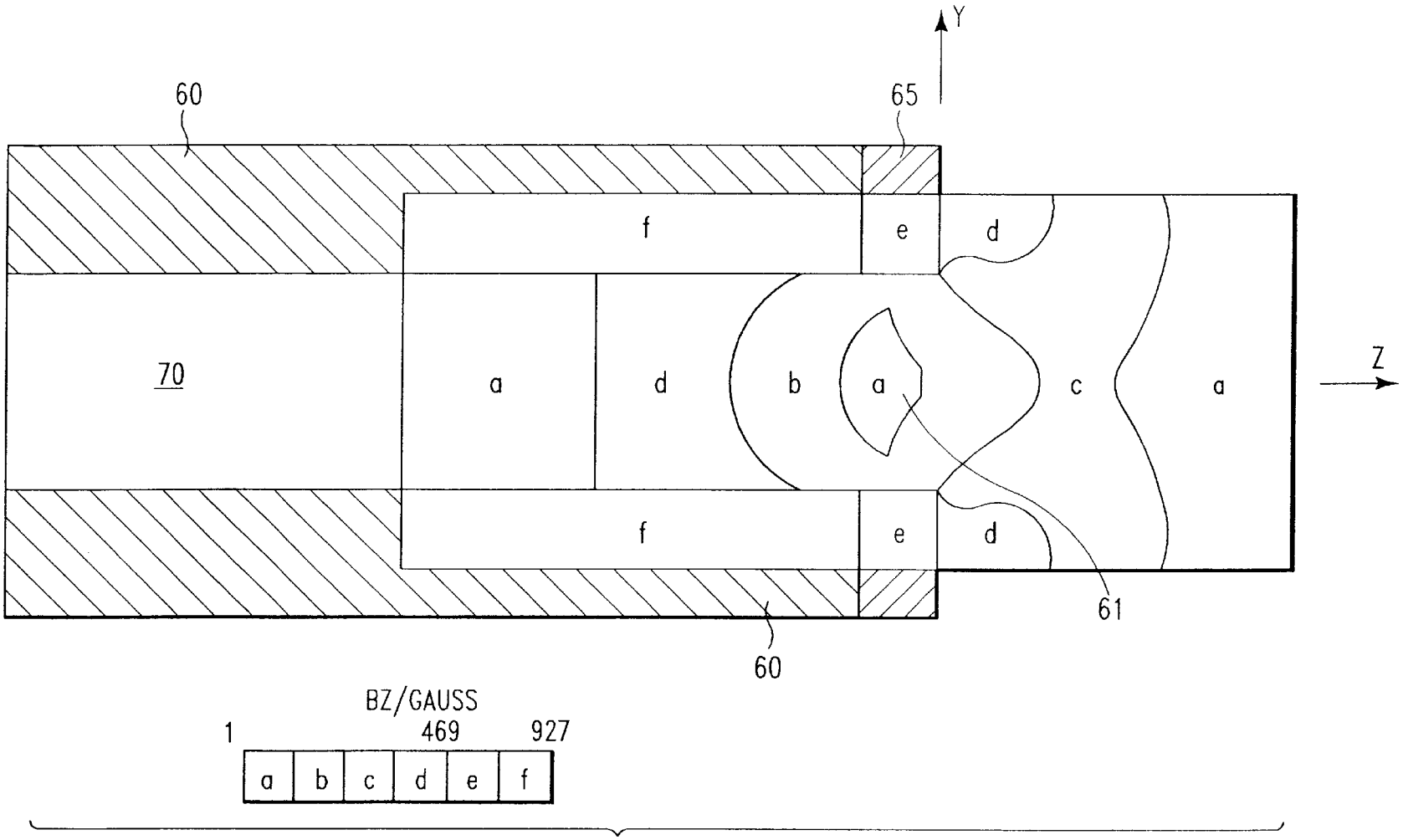
FIG. 20 is a cross sectional view of a well of an electron source embodying the present invention with a high magnetic permeability layer and the associated magnetic field distribution superimposed thereon.

Referring now to FIG. 20, in another preferred embodiment of the present invention, a layer 65 of a high permeability material such as iron is located adjacent the entrance to well 70. This increases the curvature of the magnetic field shape at the entrance to well 70, locates null region 61 inside well 70, reduces the volume of space occupied by null region 61, and linearizes the magnetic field at magnet 60. The net result is less disturbance of electron beam 30 as it is collected by the electrostatic field produced by grid 40. In a particularly preferred embodiment of the present invention, high permeability layer 65 is implemented by forming at least one of grid conductors 41 and 42 from high permeability material. It will be appreciated that, in some embodiments of the present invention, the effect of high permeability layer 65 may be enhanced by connecting it to a fixed voltage. It will also be appreciated that, in some embodiments of the present invention, high permeability layer 65 may be divided into a two layers to provide first and second grid structures 41 and 42.

Figure 14:
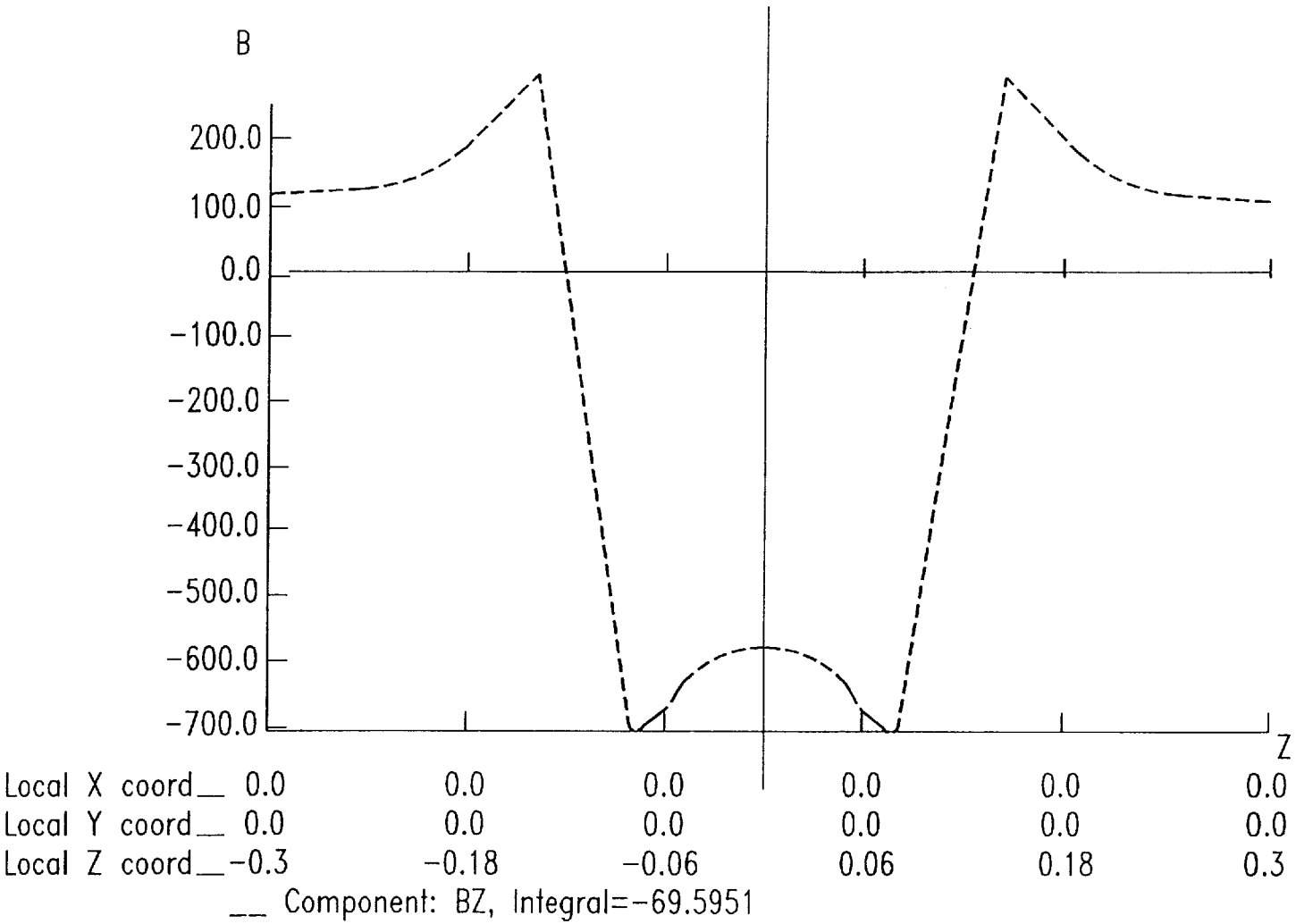
FIG. 14 is a graph of on axis magnetic field intensity in a well of an electron source embodying the present invention.
Figure 21:
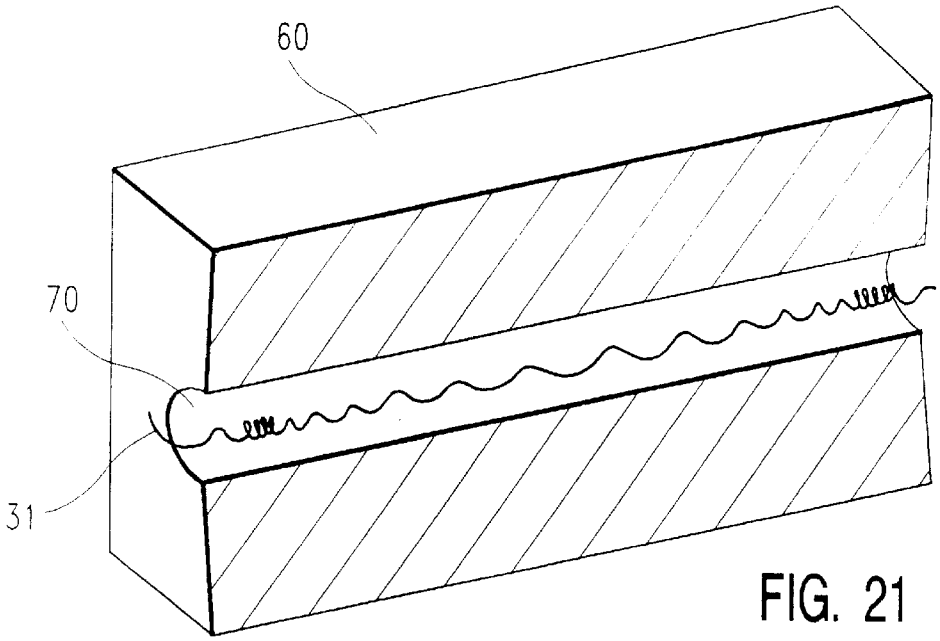
FIG. 21 is a cross sectional view of a well of an electron source embodying the present invention showing an electron path through the well.
Figure 23:
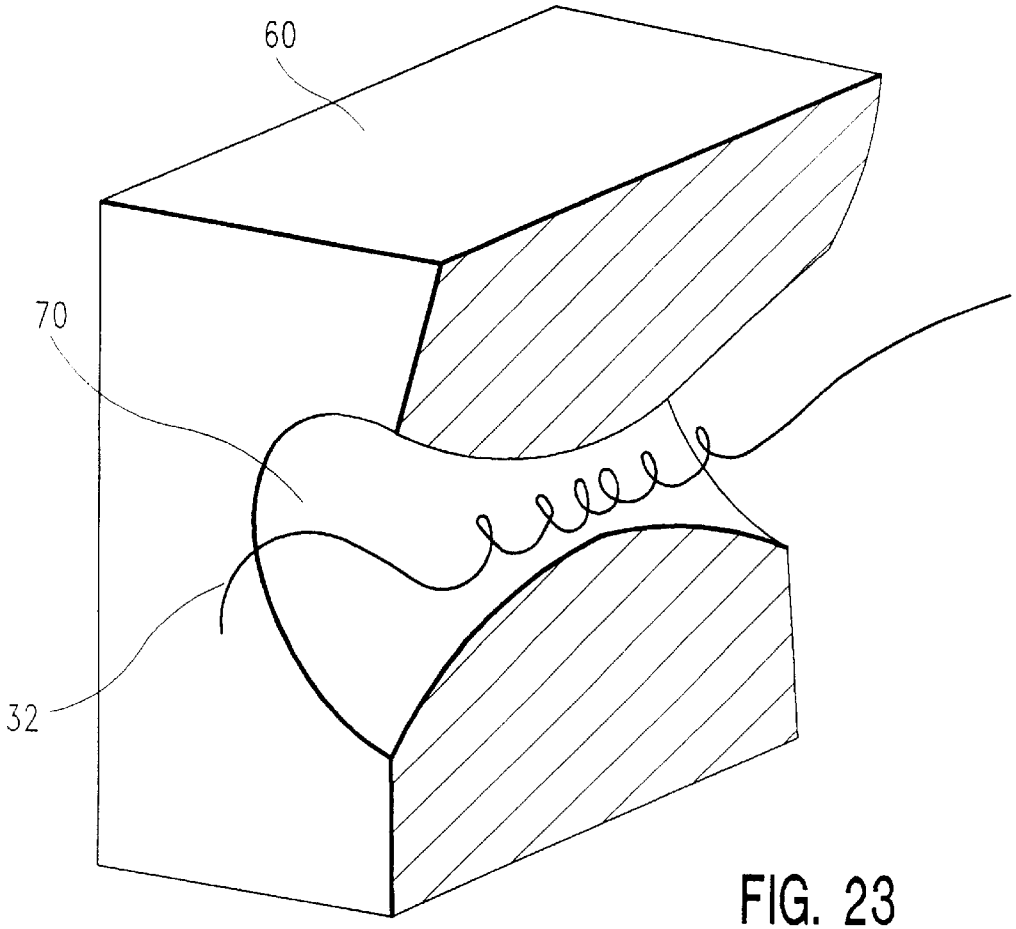
FIG. 23 is a cross sectional view of a tapered well of an electron source embodying the present invention showing an electron path through the well.
Figure 22:
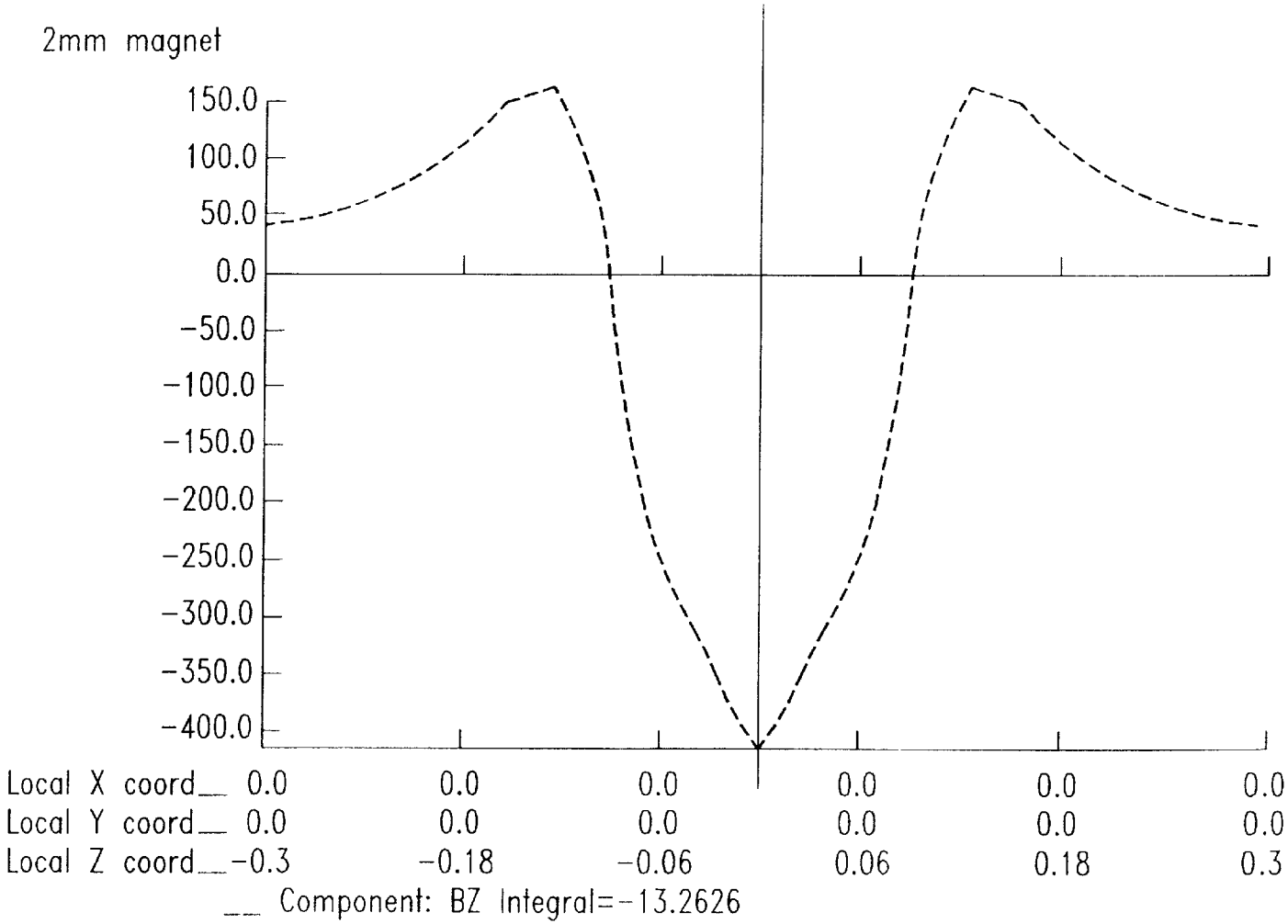
FIG. 22 is a graph of on axis magnetic field intensity in a tapered well of an electron source embodying the present invention.

Referring back to the on Z axis field intensity plot of FIG. 14, it will be appreciated that the magnetic field intensity is reduced towards to the center of well 70. Referring to FIG. 21, the reduction causes an increase in the diameter of the spiral path 31 of electrons in well 70, and an increase in the length of repeat distance. Tapering well 70 modifies the magnetic field intensity distribution therein. Thus, tapering may be employed to linearize the magnetic field intensity along well 70, or to increase the intensity at the center of well 70. For example, FIG. 22 shows an on Z axis intensity graph for a tapered pixel well. The intensity has a maximum at the center of well 70. Referring to FIG. 23, the corresponding spiral path 32 of electron in such a well 70 is very uniform.

When electrons are focused into a tight beam, the mutual repulsion between their negative charges tends to make them diverge. In a collimating magnetic field however, divergence is prevented because the electrons are urged to spiral around the magnetic force lines. The magnetic field thus acts as an effective counter-measure to space charge repulsion.

While the invention has been particularly shown and described with respect to preferred embodiments thereof, it will be understood by those skilled in the art that the foregoing and other changes in form and details may be made therein without departing from the spirit and scope of the invention.

Having thus described our invention, what we claim as new, and desire to secure by letters patent is:

1. An electron source comprising: a cathode; a permanent magnet block perforated by a plurality of channels extending between opposite poles of the magnet block, each channel having an entry side proximate to the cathode and a length which is larger than its width, the magnet block generating, in each channel, a magnetic field which acts upon electrons received from the cathode for a sufficient time to form an electron beam for guidance towards a target; grid electrode means disposed between the cathode and the magnet block for controlling flow of electrons from the cathode into each channel; and positioning means for positioning a magnetic field null region located at the entry side of each channel to a location remote from the grid electrode means such that the impedance of the electron beams due to the magnetic field null region is lessened.

2. An electron source as claimed in claim 1, wherein the positioning means comprises spacing means for spacing the grid electrode means from the surface of the magnet.

3. An electron source as claimed in claim 1, wherein the grid electrode means is disposed on the surface of the cathode means facing the magnet.

4. An electron source as claimed in claim 1, wherein the grid electrode means is disposed on the surface of the magnet facing the cathode means.

5. An electron source as claimed in claim 1, wherein the positioning means comprises a tapered entrance to each channel, the end of the taper having the largest surface area facing the cathode means.

6. An electron source as claimed in claim 1, wherein the positioning means comprises a non-uniform orientation of magnetic domains within the magnet.

7. An electron source as claimed in claim 1, wherein the positioning means comprises a high magnetic permeability material.

8. An electron source as claimed in claim 7, wherein the high permeability material is located in a layer disposed on the surface of the magnet facing the cathode means.

9. An electron source as claimed in claim 7, wherein the high permeability material is located in the grid electrode means.

10. An electron source as claimed in claim 9, wherein the material comprises iron.

11. An electron source as claimed in claim 1, wherein the channels are disposed in the magnet in a two dimensional array of rows and columns.

12. An electron source as claimed in claim 11, wherein the grid electrode means comprises a plurality of parallel row conductors and a plurality of parallel column conductors arranged orthogonally to the row conductors, each channel being located at a different intersection of a row conductor and a column conductor.

13. An electron source as claimed in claim 1, wherein the cathode means comprises a field emission device.

14. An electron source as claimed in claim 1, wherein the cathode means comprises a semiconducting material.

15. An electron source as claimed in claim 1, wherein each channel varies in cross-section along its length.

16. An electron source as claimed in claim 15, wherein the each channel is tapered, the end of the channel having the largest surface area facing the cathode means.

17. An electron source as claimed in claim 1, wherein the magnet comprises ferrite.

18. An electron source as claimed in claim 1, wherein the magnet comprises a metal.

19. An electron source as claimed in claim 1, wherein the magnet comprises a binder.

20. An electron source as claimed in claim 19, wherein the binder comprises silicon dioxide.

21. An electron source as claimed in claim 1, wherein each channel is circular in cross-section.

22. An electron source as claimed in claim 1, wherein each channel is quadrilateral in cross-section.

23. An electron source as claimed in claim 1, wherein the corners and edges of each channel are radiussed.

24. An electron source as claimed in claim 1, wherein the magnet comprises a stack of perforated laminations, the perforations in each lamination being aligned with the perforations in an adjacent lamination to continue the channel through the stack.

25. An electron source as claimed in claim 24, wherein each lamination in the stack is separated from an adjacent lamination by a spacer.

26. An electron source as claimed in claim 1, comprising anode means disposed on the surface of the magnet remote from the cathode for accelerating electrons through the channels.

27. An electron source as claimed in claim 26, wherein the anode means comprises a plurality of anodes extending parallel to the columns of channels, the anodes comprising pairs of anodes each corresponding to a different column of channels, each pair comprising first and second anodes respectively extending along opposite sides of the corresponding column of anodes, the first anodes being interconnected and the second anodes being interconnected.

28. An electron source as claimed in claim 27, wherein the first and second anodes comprise lateral formations surrounding corners of the channels.

29. A display device comprising: an electron source as claimed in claim 28; a screen for receiving electrons from the electron source, the screen having a phosphor coating facing the side of the magnet remote from the cathode; and means for supplying control signals to the grid electrode means and the anode means to selectively control flow of electrons from the cathode to the phosphor coating via the channels thereby to produce an image on the screen.

30. An electron source as claimed in claim 27, comprising means for applying a deflection voltage across the first and second anodes to deflect electron beams emerging from the channels.

31. A display device comprising: an electron source as claimed in claim 30; a screen for receiving electrons form the electron source, the screen having a phosphor coating facing the side of the magnet remote from the cathode, the phosphor coating comprising a plurality of groups of different phosphors, the groups being arranged in a repetitive pattern, each group corresponding to a different channel; means for supplying control signals to the grid electrode means and the anode means to selectively control flow of electrons from the cathode to the phosphor coating via the channels; and deflection means for supplying deflection signals to the anode means to sequentially address electrons emerging from the channels to different ones of the phosphors for the phosphor coating thereby to produce a color image on the screen.

32. A display device as claimed in claim 31, wherein the phosphors comprise Red, Green, and Blue phosphors.

33. A display device as claimed in claim 32, wherein the deflection means is arranged to address electrons emerging from the channels to different ones of the phosphors in the repetitive sequence Red, Green, Red, blue.

34. A display device as claimed in claim 30, comprising a final anode layer disposed on the phosphor coating.

35. A display device as claimed in claim 30, wherein the screen is arcuate in at least one direction and each interconnection between adjacent first anodes and between adjacent second anodes comprises a resistive element.

36. A display device as claimed in claim 30, comprising means for dynamically varying a DC level applied to the anode means to align electrons emerging from the channels with the phosphor coating on the screen.

37. A display device as claimed in claim 30, comprising an aluminum backing adjacent the phosphor coating.

38. A method for generating electron beams comprising: generating a magnetic field in each of plurality of channels extending between opposite poles of a magnet block, each channel having an entry side proximate to the cathode and a length which is larger than its width, the magnetic field act upon electrons received from the cathode for a sufficient time to form an electron beam for guidance towards a target; controlling flow of electrons from the cathode into each channel via grid electrode means disposed between the cathode and the magnet block; and positioning a magnetic field null region located at the entry side of each channel to a location remote from the grid electrode means such that the impedance of the electron beams due to the magnetic field null region is lessened.

39. A method as claimed in claim 38, wherein the positioning step comprises spacing the grid electrode means from the surface of the magnet.

40. A method as claimed in claim 38, wherein the positioning step comprises tapering the entrance to each channel, the end of the taper having the largest surface area facing the cathode means.

41. A method as claimed in claim 38, wherein the positioning step comprises non-uniformly orienting magnetic domains within the magnet.

42. A method as claimed in claim 38, wherein the positioning step comprises disposing a layer of high magnetic permeability material on the surface of the magnet facing the cathode means.

43. A method as claimed in claim 42, wherein the positioning step comprises forming the grid electrode means at least partially from a high magnetic permeability material.

* * * * *

UNITED STATES PATENT AND TRADEMARK OFFICE

CERTIFICATE OF CORRECTION

PATENT NO. : 5,861,712

DATED : January 19, 1999

INVENTOR(S) : John Beeteson, et al.

It is certified that error appears in the above-identified patent and that said Letters Patent is hereby corrected as shown below:

On the Title Page, after Section [22] insert the follow:

-- Foreign Application Priority Data

Aug. 25, 1995 [UK] United Kingdom.....9517465.2

Feb. 28, 1996 [UK] United Kingdom.....9604226.2 --

Column 4, line 22: "view-of" should read --view of--

Column 5, line 30: "Control grid 40..." should not begin a new paragraph.

Signed and Sealed this

Seventh Day of November, 2000

*Attest:*

Q. TODD DICKINSON

*Attesting Officer*

*Director of Patents and Trademarks*